US006872687B2

(12) United States Patent
Shimada et al.

(10) Patent No.: US 6,872,687 B2
(45) Date of Patent: Mar. 29, 2005

(54) THERMOSENSITIVE RECORDING MATERIAL

(75) Inventors: Hirokazu Shimada, Shizuoka-ken (JP); Fumiya Tabata, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 132 days.

(21) Appl. No.: 10/273,371

(22) Filed: Oct. 18, 2002

(65) Prior Publication Data

US 2003/0114302 A1 Jun. 19, 2003

(30) Foreign Application Priority Data

Oct. 18, 2001 (JP) ..... 2001-320195

(51) Int. Cl.[7] ..... B41M 5/30
(52) U.S. Cl. ..... 503/200; 428/32.64
(58) Field of Search ..... 428/32.64; 503/200, 503/226

(56) References Cited

U.S. PATENT DOCUMENTS 6,667,275 B2 * 12/2003 Sano et al. ..... 503/200
6,693,062 B2 * 2/2004 Dooms et al. ..... 503/201

FOREIGN PATENT DOCUMENTS

| | | |
|---|---|---|
| JP | 8-282112 | 10/1996 |
| JP | 2001-110050 | 4/2001 |
| JP | 2002-307827 | 10/2002 |

* cited by examiner

*Primary Examiner*—Bruce H. Hess
(74) *Attorney, Agent, or Firm*—Sughrue Mion, PLLC

(57) ABSTRACT

A thermosensitive recording material having at least a thermosensitive recording layer on one surface of a support and a back coat layer on the other surface of the support, wherein the black coat layer includes multiple layers, and an outermost layer of the back coat layer furthest from the support contains polyvinyl alcohol, an inorganic stratiform compound, and an inorganic pigment. According to the thermosensitive recording material curling caused by a change in environment or by application of heat during recording can be prevented and a coefficient of friction of a back coat layer can be regulated to within a predetermined range.

15 Claims, No Drawings

THERMOSENSITIVE RECORDING MATERIAL

BACKGROUND OF THE INVENTION

1. Field of the Invention

The present invention relates to a thermosensitive recording material, and particularly to a thermosensitive material having superior anticurling properties and having a proper coefficient of friction.

2. Description of the Related Art

Thermosensitive materials in which heat is provided by a thermal head or the like to record images are relatively cheap, and recording devices for use therewith are simple, highly reliable, and maintenance-free. Accordingly, the thermosensitive materials are widely used. In recent years, attempts are especially being made to realize high image quality and high performance, such as improvements in preservability.

On the other hand, the thermosensitive materials have a problem in quality in that an elongation balance between front and back surface layers of the thermosensitive recording material is lost due to a change in environment, such as humidity, or due to application of heat during recording, thereby causing so-called curling, i.e., one surface side of the thermosensitive recording material is deformed in a curled state. In particular, such a phenomenon has been markedly observed in multilayered color thermosensitive recording materials in which plural thermosensitive recording layers having different color development hues are superimposed.

Even when high image quality and high performance, such as improvements in preservability, are realized, such curling extremely impairs product quality as a recording material.

In order to prevent such curling from occurring, in addition to a thermosensitive recording layer, a protective layer and the like, the thermosensitive recording material is provided with a back coat layer on a surface (back surface) at a side of a support at which the thermosensitive recording layer and the like are not provided. For example, Japanese Patent Application Laid-Open (JP-A) No. 8-282112 discloses a technique for providing on a support a back coat layer comprising a single layer, and including an inorganic stratiform compound in the back coat layer. Certainly, by providing a layer containing the inorganic stratiform compound on the surface opposite to the side having the thermosensitive recording layer, curling of the whole of the recording material is inhibited to some extent. However, curling under a low-humidity environment cannot be completely prevented, thereby causing deformation in the curled state, so that there is still a problem in quality as a recording material. Further, even in a color thermosensitive recording material having a multilayered thick recording layer, curling is liable to occur, so that there is a problem in maintaining flatness.

In particular, in recent years as imaging techniques of various modes have been provided, and colorization of images has progressed and become important, not only realization of high performance, such as high image quality and improvements in preservability, is required, but also that the quality of the material itself as a recording medium is not impaired and is stable. In addition, a range of application may possibly be limited by the curling.

Thus, the present assignee previously proposed in Japanese Patent Application No. 2001-110050 a thermosensitive recording material in which polyvinyl alcohol and water-swelling mica are contained in a back coat layer, and curling by a change in environment, such as humidity, during use or by application of heat during recording can be avoided, and which is free from reduction in quality by deformation of the material and can be applied in a wide range of fields. However, the back coat layer of this thermosensitive recording material has a low coefficient friction. During delivery of many thermosensitive recording materials in a superimposed state, since a thermosensitive recording layer on a front surface of one thermosensitive recording material and the back coat layer of another thermosensitive recording material are slippery, there may be cases where trouble occurs during delivery. Thus, there is still room for improvement.

SUMMARY OF THE INVENTION

The present invention is aimed to solve the above-described problems of the related art and to attain the following object.

Namely, an object of the invention is to provide a thermosensitive recording material capable of preventing curling caused by a change in environment or by application of heat during recording and of regulating a coefficient of friction of a back coat layer within a predetermined range.

Means for achieving the above-described aim are as follows.

The present invention provides a thermosensitive recording material comprising a thermosensitive recording layer on one surface of a support and a back coat layer on the other surface of the support, wherein the back coat layer comprises multiple layers, and an outermost layer of the back coat layer furthest from the support contains polyvinyl alcohol, an inorganic stratiform compound, and an inorganic pigment.

In one embodiment, the inorganic stratiform compound of the thermosensitive recording material includes synthetic mica.

In another embodiment, the synthetic mica of the thermosensitive recording material has an aspect ratio of 100 or more.

In another embodiment, the thermosensitive recording layer of thermosensitive recording material comprises at least one of a recording layer containing an electron-donating dye precursor and an electron-accepting compound, which reacts with the electron-donating dye precursor to make the electron-donating dye precursor undergo color development, and a recording layer containing a diazonium salt compound and a coupler, which reacts with the diazonium salt compound to make the diazonium salt compound undergo color development.

Even further, the invention provides the foregoing thermosensitive recording material, wherein the support is a paper support, at least one surface of which is laminated with polyethylene.

DETAILED DESCRIPTION OF THE PREFERRED EMBODIMENTS

In the thermosensitive recording material according to the present invention, a back coat layer comprising multiple layers is provided on the surface of a support in a side at which no thermosensitive recording layer is provided, and an outermost layer of the back coat layer furthest from the support contains polyvinyl alcohol, an inorganic stratiform compound, and an inorganic pigment.

The thermosensitive recording material according to the invention will be hereunder described in detail. Incidentally, the polyvinyl alcohol as referred to herein means polyvinyl alcohol and/or modified polyvinyl alcohol.

The thermosensitive recording material according to the invention comprises at least a thermosensitive recording layer on one surface of the support, which may be comprised of a single layer or plural layers, and may contain other layers such as a protective layer, if desired. Further, the thermosensitive recording material according to the invention comprises a back coat layer comprising multiple layers on the other surface of the support and may contain other layers, if desired.

Back Coat Layer:

The back coat layer is constituted of a laminate of multiple layers of two or more layers, i.e., is constituted of an outermost layer furthest from the support (this outermost layer will be sometimes referred to simply as "outermost back layer") and a layer comprising one layer or two or more layers positioned between the outermost layer and the support (this layer will be sometimes referred to as "intermediate back layer").

Outermost Back Layer:

The outermost back layer comprises at least polyvinyl alcohol as a binder, an inorganic stratiform compound, and an inorganic pigment and optionally contains other components.

For example, in a humidity environment biased to the low-humidity or high-humidity side, a large amount of moisture is likely released or absorbed as a water vapor in the layers to be brought into contact with air. In this case, when an expansion and contraction balance on the both surfaces of the support collapses, curling is liable to occur on either one surface. Especially, in the case of a color thermosensitive recording material comprising multiple layers, a degree of absorption or release of moisture is greatly different between the side having a multilayered recording layer and the side not having such a layer. Accordingly, the expansion and contraction balance collapses more likely, possibly resulting in deformation. However, by providing a back coat layer comprising multiple layers on the surface (back surface) at which no thermosensitive recording layer is provided and containing polyvinyl alcohol in its outermost layer, the moisture kept in a layer adjacent to the outermost layer can be insulated by the outermost layer, and the moisture transfer in the layer following a humidity change in air can be blocked, whereby the expansion and contraction balance between the front and back surfaces becomes easy to keep. Such is liable to be promoted during the thermal recording, but is also effective for maintaining the expansion and contraction balance between the front and back surfaces by application of heat.

Examples of the modified polyvinyl alcohol include carbonyl-modified polyvinyl alcohol, carboxy-modified polyvinyl alcohol, silanol-modified polyvinyl alcohol, and ethylene-modified polyvinyl alcohol.

A degree of saponificaion of the polyvinyl alcohol and/or modified polyvinyl alcohol to be used in the invention is preferably 88% or more, and more preferably 97% or more from the standpoint of prevention of curling from occurrence.

An applied amount of the polyvinyl alcohol in the outermost back layer is preferably from 0.3 to 5.3 g/m$^2$. When the applied amount falls within the above-specified range, a preferable curling characteristic can be obtained.

A degree of polymerization of the polyvinyl alcohol is preferably from 300 to 1,700, and more preferably from 300 to 1,000.

As the inorganic stratiform compound, are enumerated micas represented by the following general formula (1):

$$A(B, C)_{2\text{-}3}D_4O_{10}(OH, F, 0)_2 \quad (1)$$

wherein A represents K, Na, or Ca; B and C independently represent Fe(II), Fe(III), Mn, Al, Mg, or V; and D represents Si or Al, talc represented by $3MgO.4SiO_2.H_2O$, taeniolite, montmorillonite, saponite, hectorite, and zirconium phosphate.

Examples of the micas represented by the general formula (1) include natural micas such as muscovite, paragonite, phlogopite, biotite, and lepidolite; and synthetic micas such as non-swelling micas, e.g., fluorophlogopite $KMg_3(AlSi_3O_{10})F_2$ and potassium tetrasilicic mica $KMg_{2.5}(Si_4O_{10})F_2$, and sewlling micas, e.g., sodium tetrasilicic mica $NaMg_{2.5}(Si_4O_{10})F_2$, sodium or lithium taeniolite (Na, Li)$Mg_2Li(Si_1O_{10})F_2$ and montmorillonite-based sodium or lithium hectorite (Na, Li)$_{1/3}Mg_{2/3}Li_{1/3}(Si_4O_{10})F_2$. Further, synthetic smectite is also useful.

In the invention, water-swelling synthetic micas are preferred, and swelling fluorine-based synthetic micas are particularly preferred in the foregoing stratiform compounds.

An aspect ratio of the inorganic stratiform compound is preferably 20 or more, more preferably 100 or more, and particularly preferably 200 or more. When the aspect ratio is less than 100, the moisture transfer within the layer cannot be blocked, and hence, the curling may not be effectively prevented. When the aspect ratio is 200 or more, there gives rise to a large effect particularly in preventing the curling. The aspect ratio as referred to herein means a ratio of thickness to long diameter of the particles of the stratiform compound.

Further, a particle size of the inorganic stratiform compound is preferably from 0.3 to 20 $\mu$m, more preferably from 0.5 to 10 $\mu$m, and particularly preferably from 1 to 5 $\mu$m in terms of mean long diameter.

A mean thickness of the stratiform compound is preferably 0.1 $\mu$m or less, more preferably 0.05 $\mu$m or less, and particularly preferably 0.01 $\mu$m or less.

A content of the inorganic stratiform compound in the outermost back layer is preferably from 3 to 30 parts by weight, and more preferably from 5 to 20 parts by weight based on 100 parts by weight of the polyvinyl alcohol. When the content of the inorganic stratiform compound falls within the above-specified range, the expansion and contraction balance between the front and back surfaces of the thermosensitive recording material can be kept, the curling can be sufficiently prevented from occurrence, and the production aptitude such as coating properties becomes good.

In the outermost back layer, a content ratio of the inorganic stratiform compound (x) to the binder (y) (weight ratio: x/y) is preferably within a range of from 3/100 to 20/100.

When the content ratio falls within the above-specified range, the expansion and contraction balance between the front and back surfaces of the thermosensitive recording material can be kept, and the curling can be sufficiently prevented from occurrence.

Even in the case where plural kinds of inorganic stratiform compounds are used, it is preferred that the total sum of the inorganic stratiform compounds falls within the above-specified weight ratio range.

In the invention, the outermost back layer further contains an inorganic pigment. By properly regulating the content of the inorganic pigment, it is possible to regulate the coefficient of friction of the outermost back layer. The inorganic pigment is not particularly limited. Examples include kaolin, calcined kaolin, talc, agalmatolite, diatomaceous earth, calcium carbonate, aluminum hydroxide, magnesium hydroxide, zinc oxide, lithopone, amorphous silica, colloidal silica, calcined gypsum, silica, magnesium carbonate, titanium oxide, alumina, barium carbonate, and barium sulfate, with aluminum hydroxide being preferred.

A content of the inorganic pigment is preferably from 30 to 500 parts by weight, and more preferably from 50 to 300 parts by weight based on 100 parts by weight of the polyvinyl alcohol.

A particle size (volume average particle size) of the inorganic pigment is preferably from 0.1 to 2.0 μm, and more preferably from 0.2 to 1.0 μm.

Other Components:

So far as the effects of the invention are not impaired, the outermost back layer may contain a metallic soap, a wax, a water-resisting agent, and the like from the standpoints of running properties during the recording, etc.

As the metallic soap, are numerated higher fatty acid polyvalent metal salts. Specific examples include zinc stearate, aluminum stearate, calcium stearate, and zinc oleate.

As the wax, are employable ones having a melting point of from 40 to 120° C. Preferred examples include paraffin wax, polyethylene wax, carnauba wax, microcrystalline wax, candelilla wax, montan wax, and fatty acid amide-based waxes, with paraffin wax, montan wax and methylol stearamide, each having a melting point of from 50 to 100° C., being more preferred.

A content of the wax in the thermosensitive recording material is preferably from 5 to 200 parts by weight, and more preferably from 20 to 150 parts by weight based on 100 parts by weight of the electron-donating colorless dye.

Examples of the water-resisting agent include water-soluble initial condensates such as N-methylolurea, N-methylolmelamine, and urea-formalin; dialdehyde compounds such as glyoxal and glutaraldehyde; inorganic crosslinking agents such as boric acid and borax; and blend thermal processing products such as polyacrylic acid, a methyl vinyl ether-maleic acid copolymer, and an isobutylene-maleic anhydride copolymer.

The outermost back layer may contain a surfactant from the viewpoint of obtaining a uniform layer during the application on the support. As the surfactant, are suitably enumerated sulfosuccinic acid-based alkali metal salts and fluorine-based surfactants. Concretely, sodium salts and ammonium salts of di-(n-hexyl)sulfosuccinic acid and di(2-ethylhexyl)sulfosuccinic acid are preferred, and anionic surfactants are suitable.

A layer thickness of the outermost back layer is preferably from 0.3 to 6 μm, and more preferably from 0.5 to 3 μm. When the outermost back layer has a layer thickness of from 0.3 to 6 μm, the expansion and contraction balance between the front and back surfaces of the thermosensitive recording material can be kept, and the curling can be sufficiently prevented from occurrence.

Intermediate Back Layer:

The intermediate back layer contains at least a water-soluble binder and may contain other components, if desired. By providing the intermediate back layer, the expansion and contraction balance can be made better, and the curling of the thermosensitive recording material can be effectively prevented from occurrence.

The intermediate back layer can be formed by using, as the water-soluble binder, a water-soluble polymeric material (such as a vinyl acetate-acrylamide copolymer, silicon-modified polyvinyl alcohol, starch, modified starch, methyl cellulose, carboxymethyl cellulose, hydroxymethyl cellulose, gelatins, gum arabic, casein, a styrene-maleic acid copolymer hydrolyzate, a styrene-maleic acid copolymer half ester hydrolyzate, an isobutylene-maleic anhydride copolymer hydrolyzate polyacrylamide derivatives, polyvinylpyrrolidone, sodium polysulfonate, and sodium alginate) and a water-insoluble polymer (such as a styrene-butadiene rubber latex, an acrylonitrile-butadiene rubber latex, a methyl acrylate-butadiene rubber latex, and a vinyl acetate emulsion). As other components, are enumerated a latex and a water-resisting agent. Of these, are preferable gelatins.

A layer thickness of the intermediate back layer is preferably from 2 to 15 μm, and more preferably from 4 to 10 μm. When the outermost back layer has a layer thickness of from 2 to 15 μm, the expansion and contraction balance between the front and back surfaces of the thermosensitive recording material can be kept, and the curling can be sufficiently prevented from occurrence.

The outermost back layer and the intermediate back layer can be formed by, for example, applying each of coating liquids for forming the outermost back layer and for forming the intermediate back layer (coating liquid for outermost back layer and coating liquid for intermediate back layer) on the support by a known coating method. In this case, the coating liquid for outermost back layer and the coating liquid for intermediate back layer may be applied simultaneously. Alternatively, the coating liquid for intermediate back layer may be first applied and dried, and the coating liquid for outermost back layer may be then applied thereto, followed by drying.

Examples of the known coating method include coating methods using an air knife coater, a roll coater, a blade coater, or a curtain coater.

Thermosensitive Recording Layer:

The thermosensitive recording layer contains a color development component and optionally other components such as a binder and a base. As the color development component, are suitably enumerated (1) a combination of a diazonium salt compound with a coupler which reacts with the diazonium salt compound to make the diazonium salt compound undergo color development and (2) a combination of an electron-donating dye precursor with an electron-accepting compound which reacts with the electron-donating dye precursor to make the electron-donating dye precursor undergo color development.

Diazonium Salt Compound:

As the diazonium salt compound, is enumerated a compound represented by the following formula (2):

$$Ar—N_2^+X. \quad (2)$$

wherein Ar represents an aromatic moiety, and X. represents an acid anion.

The diazonium salt compound is a compound which causes a coupling reaction with a coupler as described later by heating, to undergo color development, and is decomposed by light. It is possible to regulate its maximum absorption wavelength by the position or type of a substituent in the Ar moiety.

Specific examples of the diazonium that forms a salt include 4-(p-tolylthio)-2,5-dibutoxybenzenediazonium, 4-(4-chlorophenylthio)-2,5-dibutoxybenzenediazonium, 4-(N,N-dimethylamino)benzenediazonium, 4-(N,N-diethylamino)benzenediazonium, 4-(N,N-dipropylamino) benzenediazonium, 4-(N-methyl-N-benzylamino) benzenediazonium, 4-(N,N-dibenzylamino) benzenediazonium, 4-(N-ethyl-N-hydroxyethylamino) benzenediazonium, 4-(N,N-diethylamino)-3-methoxybenzenediazonium, 4-(N,N-dimethylamino)-2-methoxybenzenediazonium, 4-(N-benzoylamino)-2,5-diethoxybenzenediazonium, 4-morpholino-2,5-dibutoxybenzenediazonium, 4-anilinobenzenediazonium, 4-[N-(4-methoxybenzoyl)amino]-2,5-diethoxybenzenediazonium, 4-pyrrolidino-3-ethylbenzenediazonium, 4-[-N-(1-methyl-2-(4-methoxyphenoxy)ethyl)-N-hexylamino]-2-hexyloxybenzenediazonium, 4-[N-(2-(4-methoxyphenoxy) ethyl)-N-hexylamino]-2-hexyloxybenzenediazonium, 2-(1-ethylpropyloxy)-4-[di-(di-n-butylaminocarbonylmethyl) amino]benzenediazonium, and 2-benzylsulfonyl-4-[N-methyl-N-(2-octanoyloxyethyl)]aminobenzenediazonium.

A maximum absorption wavelength λmax of the diazonium salt compound is preferably 450 nm or less, and more preferably from 290 to 440 nm. When the λmax falls within the above-specified range, it is possible to attain good fresh preservability as well as good image fixability, image preservability and hue of cyan color development in the combination with a coupler as described later.

It is desired that the diazonium salt compound has 12 or more carbon atoms, and has a solubility in water of 1% or less and a solubility in ethyl acetate of 5% or more, respectively.

The diazonium salt compounds may be use singly or in admixture of two or more thereof depending on the purpose of, for example, regulation of hue.

Of the diazonium salt compounds, are more preferable diazonium salt compounds represented by the following structural formulae (1) to (3) from the viewpoints of hue of dye, image preservability, and image fixability.

Structural formula (1)

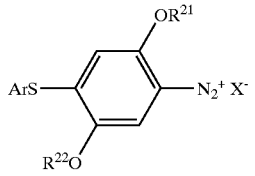

Structural formula (2)

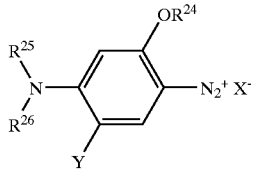

Structural formula (3)

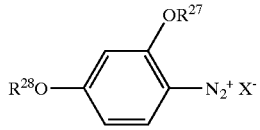

In the structural formula (1), Ar represents a substituted or unsubstituted aryl group.

Examples of the substituent include an alkyl group, an alkoxy group, an alkylthio group, an aryl group, an aryloxy group, an arylthio group, an acyl group, an alkoxycarbonyl group, a carbamoyl group, a carbonamide group, a sulfonyl group, a sulfamoyl group, a sulfonamide group, a urcido group, halogen group, an amino group, and a heterocyclic group. These substituents may further be substituted.

As the aryl group represented by Ar, is preferable an aryl group having from 6 to 30 carbon atoms. Examples include a phenyl group, a 2-methylphenyl group, a 2-chlorophenyl group, a 2-methoxyphenyl group, a 2-butoxyphenyl group, a 2-(2-ethylhexyloxy)phenyl group, a 2-octyloxyphenyl group, a 3-(2,4-di-t-pentylphenoxyethoxy)phenyl group, a 4-chlorophenyl group, a 2,5-dichlorophenyl group, a 2,4,6-trimethylphenyl group, a 3-chlorophenyl group, a 3-methylphenyl group, a 3-methoxyphenyl group, a 3-butoxyphenyl group, a 3-cyanophenyl group, a 3-(2-ethylhexyloxy)phenyl group, a 3,4-dichlorophenyl group, a 3,5-dichlorophenyl group, a 3,4-dimethoxyphenyl group, a 3-(dibutylaminocarbonylmethoxy)phenyl group, a 4-cyanophenyl group, a 4-methylphenyl group, a 4-methoxyphenyl group, a 4-butoxyphenyl group, a 4-(2-ethylhexyloxy)phenyl group, a 4-benzylphenyl group, a 4-aminosulfonylphenyl group, a 4-N,N-dibutylaminosulfonylphenyl group, a 4-ethoxycarbonylphenyl group, a 4-(2-ethylhexylcarbonyl) phenyl group, a 4-fluorophenyl group, a 3-acetylphenyl group, a 2-acetylaminophenyl group, a 4-(4-chlorophenylthio)phenyl group, a 4-(4-methylphenyl)thio-2,5-butoxyphenyl group, and a 4-(N-benzyl-N-methylamino)-2-dodecyloxycarbonylphenyl group. However, it should not be construed that the invention is limited thereto.

Further, these groups may further be substituted with, for example, an alkyloxy group, an alkylthio group, a substituted phenyl group, a cyano group, a substituted amino group, a halogen atom, or a heterocyclic group.

In the structural formula (1), $R^{21}$ and $R^{22}$ independently represent a substituted or unsubstituted alkyl group or a substituted or unsubstituted aryl group. $R^{21}$ and $R^{22}$ may be the same or different.

Examples of the substituent include an alkoxy group, an alkoxycarbonyl group, an alkylsulfonyl group, a substituted amino group, a substituted amide group, an aryl group, and an aryloxy group. However, it should not be construed that the invention is limited thereto.

As the alkyl group represented by $R^{21}$ and $R^{22}$, are preferable alkyl groups having from 1 to 18 carbon atoms, such as a methyl group, a trifluoromethyl group, an ethyl group, a propyl group, an isopropyl group, a butyl group, a sec-butyl group, a t-butyl group, a pentyl group, an isopentyl group, a cyclopentyl group, a hexyl group, a cyclohexyl group, an octyl group, a t-octyl group, a 2-ethylhexyl group, a nonyl group, an octadecyl group, a benzyl group, a 4-methoxybenzyl group, a triphenylmethyl group, an ethoxycarbonylmethyl group, a butoxycarbonylmethyl group, a 2-ethylhexyloxycarbonylmethyl group, a 2',4'-diisopentylphenyloxymethyl group, a 2',4'-di-butylphenyloxymethyl group, a dibenzylaminocarbonylmethyl group, a 2,4-di-t-amylphenyloxypropyl group, an ethoxycarbonylpropyl group, a 1-(2',4'-di-t-amylphenyloxy) propyl group, an acetylaminoethyl group, a 2-(N,N-dimethylamino)ethyl group, a 2-(N,N-diethylamino)propyl group, a methanesulfonylaminopropyl group, an acetylaminoethyl group, a 2-(N,N-dimethylamino)ethyl group, and a 2-(N,N-diethylamino)propyl group.

As the aryl group represented by $R^{21}$ and $R^{22}$, are preferable aryl groups having from 6 to 30 carbon atoms, such as a phenyl group, a 2-methylphenyl group, a 2-chlorophenyl group, a 2-methoxyphenyl group, a 2-butoxyphenyl group, a 2-(2-ethylhexyloxy)phenyl group, a 2-octyloxyphenyl group, a 3-(2,4-di-t-pentylphenoxyethoxy)phenyl group, a 4-chlorophenyl group, a 2,5-dichlorophenyl group, a 2,4,6-trimethylphenyl group, a 3-chlorophenyl group, a 3-methylphenyl group, a 3-methoxyphenyl group, a 3-butoxyphenyl group, a 3-cyanophenyl group, a 3-(2-ethylhexyloxy)phenyl group, a 3,4-dichlorophenyl group, a 3,5-dichlorophenyl group, a 3,4-dimethoxyphenyl group, a 3-(dibutylaminocarbonylmethoxy)phenyl group, a 4-cyanophenyl group, a 4-methylphenyl group, a 4-methoxyphenyl group, a 4-butoxyphenyl group, a 4-(2-ethylhexyloxy)phenyl group, a 4-benzylphenyl group, a 4-aminosulfonylphenyl group, a 4N,N-dibutylaminosulfonylphenyl group, a 4-ethoxycarbonylphenyl group, a 4-(2-ethylhexylcarbonyl) phenyl group, a 4-fluorophenyl group, a 3-acetylphenyl group, a 2-acetylaminophenyl group, a 4-(4-chlorophenylthio)phenyl group, a 4-(4-methylphenyl)thio-2,5-butoxyphenyl group, and a 4-(N-benzyl-N-methylamino)-2-dodecyloxycarbonylphenyl group. It should not be construed that the invention is limited thereto.

These groups may further be substituted with, for example, an alkyloxy group, an alkylthio group, a substituted phenyl group, a cyano group, a substituted amino group, a halogen atom, or a heterocyclic group.

In the structural formula (2), $R^{24}$, $R^{25}$, and $R^{26}$ independently represent a substituted or unsubstituted alkyl group or a substituted or unsubstituted aryl group. $R^{24}$, $R^{25}$, and $R^{26}$ may be the same or different.

Examples of the substituent include an alkyl group, an alkoxy group, an alkylthio group, an aryl group, an aryloxy group, an arylthio group, an acyl group, an alkoxycarbonyl group, a carbamoyl group, a carbamide group, a sulfonyl group, a sulfamoyl group, a sulfonamide group, a ureido group, a halogen atom, an amino group, and a heterocyclic group.

As the alkyl group represented by $R^{24}$, $R^{25}$, and $R^{26}$, are preferably alkyl groups having from 1 to 18 carbon atoms, such as the alkyl groups represented by $R^{21}$ and $R^{22}$ in the structural formula (1), and a 1-methyl-2-(4-methoxyphenoxy)ethyl group, a di-n-butylaminocarbonylmethyl group, and a di-n-octylaminocarbonylmethyl group.

The aryl group represented by $R^{24}$, $R^{25}$, and $R^{26}$ is synonymous with the aryl group represented by $R^{21}$ and $R^{22}$ in the structural formula (1). However, it should not be construed that the invention is limited thereto.

These groups may further be substituted with, for example, an alkyloxy group, an alkylthio group, a substituted phenyl group, a cyano group, a substituted amino group, a halogen atom, or a heterocyclic group.

In the structural formula (2), Y represents a hydrogen atom or an $OR^{23}$ group, wherein $R^{23}$ represents a substituted or unsubstituted alkyl group or a substituted or unsubstituted aryl group.

Examples of the substituent include an alkyl group, an alkoxy group, an alkylthio group, an aryl group, an aryloxy group, an arylthio group, an acyl group, an alkoxycarbonyl group, a carbamoyl group, a carbamide group, a sulfonyl group, a sulfamoyl group, a sulfonamide group, a ureido group, a halogen atom, an amino group, and a heterocyclic group.

It is preferred from the viewpoint of regulating the hue that Y represents a hydrogen atom or an alkyloxy group wherein $R^{23}$ represents an alkyl group.

The alkyl group represented by $R^{23}$ is synonymous with the alkyl group represented by $R^{21}$ and $R^{22}$ in the structural formula (1) However, it should not be construed that the invention is limited thereto.

The aryl group represented by $R^{23}$ is synonymous with the aryl group represented by $R^{21}$ and $R^{22}$ in the structural formula (1). However, it should not be construed that the invention is limited thereto. Further, the aryl group may further be substituted with, for example, an alkyloxy group, an alkylthio group, a substituted phenyl group, a cyano group, a substituted amino group, a halogen atom, or a heterocyclic group.

In the structural formula (3), $R^{27}$ and $R^{28}$ independently represent a substituted or unsubstituted alkyl group or a substituted or unsubstituted aryl group. $R^{27}$ and $R^{28}$ may be the same or different.

Examples of the substituent include an alkyl group, an alkoxy group, an alkylthio group, an aryl group, an aryloxy group, an arylthio group, an acyl group, an alkoxycarbonyl group, a carbamoyl group, a carbamide group, a sulfonyl group, a sulfamoyl group, a sulfonamide group, a ureido group, a halogen atom, an amino group, and a heterocyclic group.

The alkyl group represented by $R^{27}$ and $R^{28}$ is synonymous with the alkyl group represented by $R^{21}$ and $R^{22}$ in the structural formula (1). However, it should not be construed that the invention is limited thereto.

The aryl group represented by $R^{27}$ and $R^{28}$ is synonymous with the aryl group represented by $R^{21}$ and $R^{22}$ in the structural formula (1). However, it should not be construed that the invention is limited thereto. Further, the aryl group may further be substituted with, for example, an alkyloxy group, an alkylthio group, a substituted phenyl group, a cyano group, a substituted amino group, a halogen atom, or a heterocyclic group.

In the structural formulae (1) to (3), X represents an acid anion. Examples of the acid anion include polyfluoroalkylcarboxylic acids having from 1 to 9 carbon atoms, polyfluoroalkylsulfonic acids having from 1 to 9 carbon atoms, boron tetrafluoride, tetraphenylboron, hexafluoroaromatic phosphoric acid, aromatic carboxylic acids, and aromatic sulfonic acids. Of these, is preferable hexafluorophosphoric acid from the viewpoint of crystallinity.

Specific examples of the diazonium salt compound represented by the structural formulae (1) to (3) will be given below, but it should not be construed that the invention is limited thereto.

(2)-1

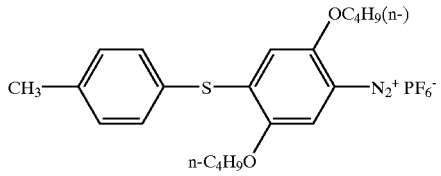

(2)-2

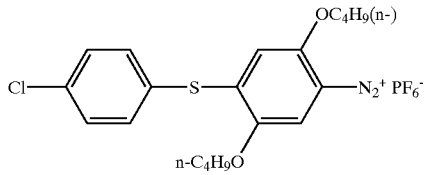

(2)-3

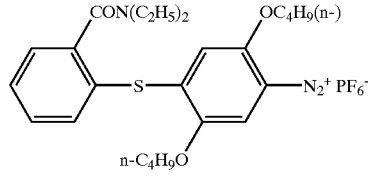

-continued (2)-4

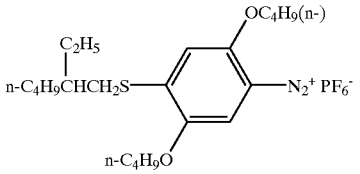

(3)-1

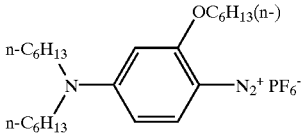

(3)-2

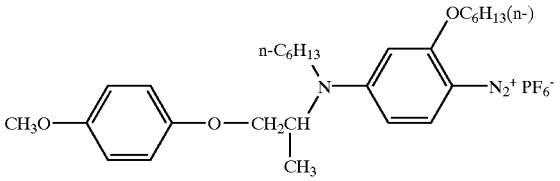

(3)-3

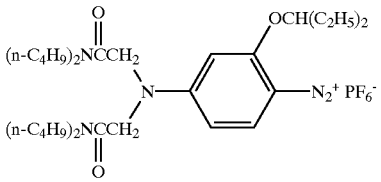

(3)-4

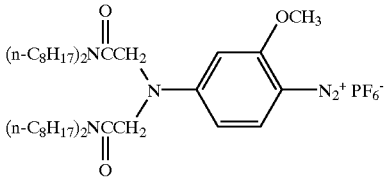

(3)-5

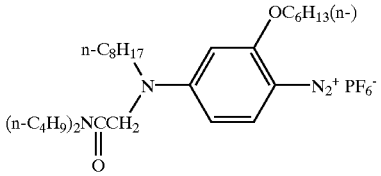

(3)-6

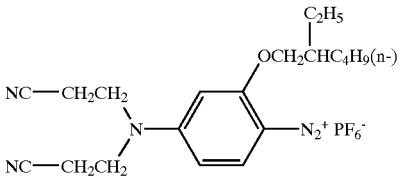

(3)-7

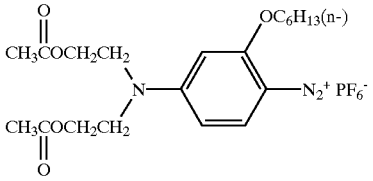

-continued (3)-8

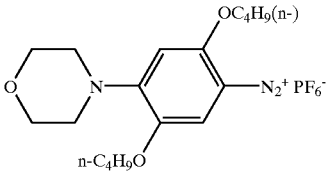

(3)-9

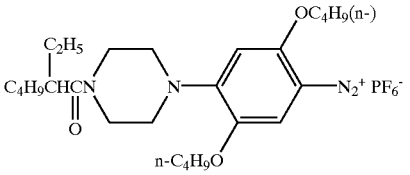

(3)-10

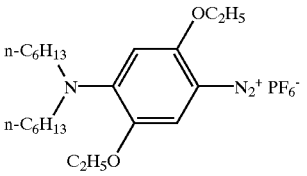

(4)-1

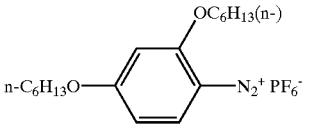

The diazonium salt compounds represented by the structural formulae (1) to (3) may be used singly or in admixture of two or more thereof. Further, the diazonium salt compounds represented by the structural formulae (1) to (3) may be used in combination with other existent diazonium salt compounds depending on various purposes of, for example, regulating the hue.

An applied amount of the diazonium salt compound is preferably from 0.05 to 2 g/m$^2$, and more preferably from 0.1 to 1 g/m$^2$ in the thermosensitive recording layer. When the applied amount of the diazonium salt compound falls within the above-specified range, not only a sufficient color development density is obtained, but also it is possible to make the coatability of the coating liquid good.

Coupler:

As the coupler that coupling reacts with the diazonium salt compound to form a dye and make it undergo color development, any compounds can be used so far as they can couple with the diazonium salt compound under a basic atmosphere and/or a neutral atmosphere to form a dye.

All of so-called 4-equivalent couplers that are used in silver halide photographic materials can be used as the coupler and properly chosen within the range coincident with the purpose of hue and the like. Examples include so-called active methylene compounds having a methylene group adjacent to a carbonyl group, phenol derivatives, and naphthol derivatives.

Of these, are particularly preferable compounds represented by the following formula (3), or tautomers thereof.

$$E^1—CH_2—E^2 \quad (3)$$

In the formula (3), $E^1$ and $E^2$ independently represent an electron attractive group, and may be the same or different.

The electron attractive group means a substituent having a positive Hammett's σ value. Examples include acyl groups such as an acetyl group, a propionyl group, a pivaloyl group, a chloroacetyl group, a trichloroacetyl group, a trifluoroacetyl group, a 1-methylcyclopropylcarbonyl group, a 1-ethylcyclopropylcarbonyl group, a 1-benzylcyclopropylcarbonyl group, a benzoyl group, a 4-methoxybenzoyl group, and a thenoyl group; alkoxycarbonyl groups such as a methoxycarbonyl group, an ethoxycarbonyl group, a 2-methoxyethoxycarbonyl group, and a 4-methoxyphenoxycarbonyl group; carbamoyl groups such as a carbamoyl group, an N,N-dimethylcarbamoyl group, an N,N-diethylcarbamoyl group, an N-phenylcarbamoyl group, an N-[2,4-bis(pentyloxy)phenyl]-carbamoyl group, an N-[2,4-bis(octyloxy)phenyl]carbamoyl group, and a morpholinocarbonyl group; alkylsulfonyl groups or arylsulfonyl groups such as a methanesulfonyl group, a benzenesulfonyl group, and a toluenesulfonyl group; phosphono groups such as a diethylphosphono group; heterocyclic groups such as a benzoxazol-2-yl group, a benzothiazol-2-yl group, a 3,4-dihydroquinazolin-4-on-2-yl group, and a 3,4-dihydroquinazoline-3-sulfon-2-yl group; a nitro group; an imino group; and a cyano group.

$E^1$ and $E^2$ may be taken together to form a ring. As the ring formed by $E^1$ and $E^2$, are preferable 5-membered or 6-membered carbon rings or hetero rings.

Specific examples of the coupler include resorcin, fluoroglucine, 2,3-dihydroxynaphthalene, sodium 2,3-dihydroxynaphthalene-6-sulfonate, 1-hydroxy-2-naphthoic acid morpholinoproylamide, sodium 2-hydroxy-3-naphthalenesulfonate, 2-hydroxy-3-naphthalenesulfonic acid anilide, 2-hydroxy-3-naphthalenesulfonic acid morpholinopropylamide, 2-hydroxy-3-naphthalenesulfonic acid 2-ethylhexyloxypropylamide, 2-hydroxy-3-naphthalenesulfonic acid 2-ethylhexylamide, 5-acetamide-1-naphthol, sodium 1-hydroxy-8-acetamidenaphthalene-3,6-disulfonate, 1-hydroxy-8-acetamidenaphthalene-3,6-disulfonic acid dianilide, 1,5-dihydroxynaphthalene, 2-hydroxy-3-naphthoic acid morpholinopropylamide, 2-hydroxy-3-naphthoic acid octylamide, 2-hydroxy-3-naphthoic acid anilide, 5,5-dimethyl-1,3-cyclohexanedione, 1,3-cyclopentanedione, 5-(2-n-tetradecyloxyphenyl)-1,3-cyclohexanedione, 5-phenyl-4-methoxycarbonyl-1,3-cyclohexanedione, 5-(2,5-di-n-octyloxyphenyl)-1,3-cyclohexanedione, N,N'-dicyclohexylbarbituric acid, N,N'-di-n-dodecylbarbituric acid, N-n-octyl-N'-n-octadecylbarbituric acid, N-phenyl-N'-(2,5-di-n-octyloxyphenyl)barbituric acid, N,N'-bis(octadecyloxycarbonylmethyl)barbituric acid, 1-phenyl-3-methyl-5-pyrazolone, 1-(2,4,6-trichlorophenyl)-3-anilino-5-pyrazolone, 1-(2,4,6-trichlorophenyl)-3-benzamide-5-pyrazolone, 6-hydroxy-4-methyl-3-cyano-1-(2-ethylhexyl)-2-pyridone, 2,4-bis(benzoylacetamide)toluene, 1,3-bis(pivaloylacetamidemethyl)benzene, benzoyl acetonitrile, thenoyl acetonitrile, acetoacetanilide, benzoyl acetanilide, pivaloyl acetanilide, 2-chloro-5-(N-n-butylsulfamoyl)-1-pivaloyl acetamidebenzene, 1-(2-ethylhexyloxypropyl)-3-cyano-4-methyl-6-hydroxy-1,2-dihydropyridin-2-one, 1-(dodecyloxypropyl)-3-acetyl-4-methyl-6-hydroxy-1,2 dihydropyridin-2-one, and 1-(4-n-octyloxyphenyl)-3-tertbutyl-5-aminopyrazole.

The details of these couplers are described in, for example, JP-A Nos. 4-201483, 7-223367, 7-223368 and 7-323660 and Japanese Patent Application Nos. 5-278608, 5-297024, 6-18669, 6-18670, 7-316280, 8-027095, 8-027096, 8-030799, 8-12610, 8-132394, 8-358755, 8-358756 and 9-069990.

Specific examples of the coupler represented by the formula (3) will be hereunder described, but it should not be construed that the invention is limited thereto.

B-1

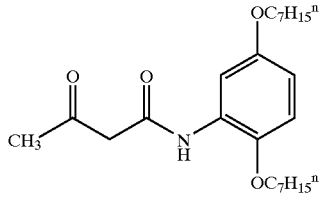

B-2

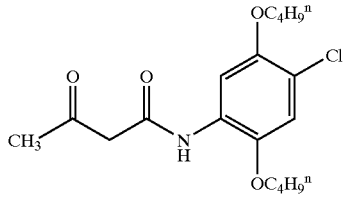

B-3

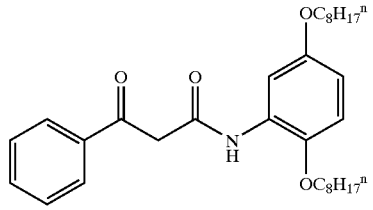

B-4

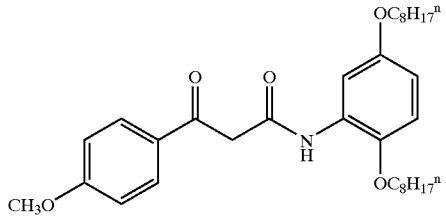

B-5

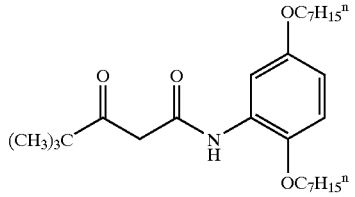

B-6

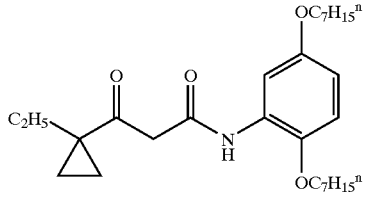

B-7

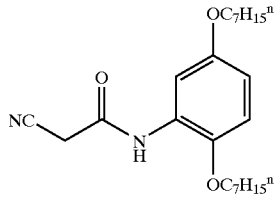

-continued
B-8
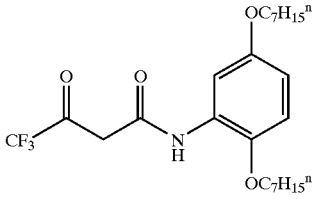
B-9
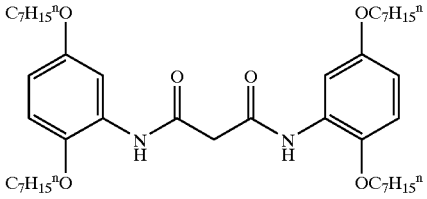
B-10
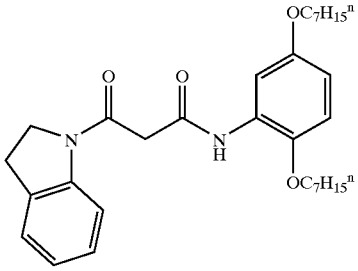
B-11
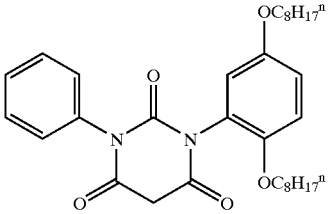
B-12
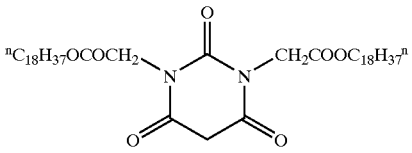
B-13
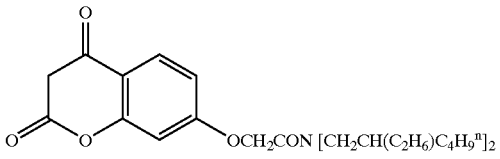
B-14
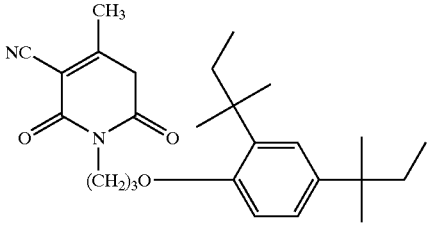
-continued
B-15
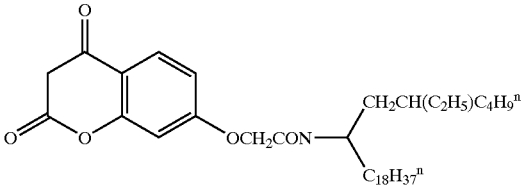
B-16
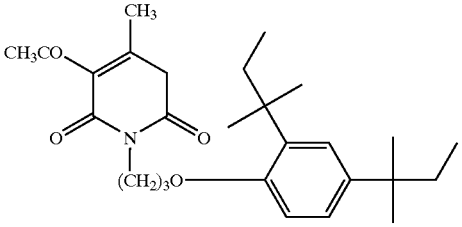
B-17
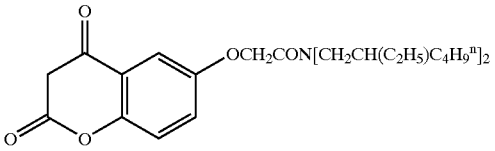
B-18
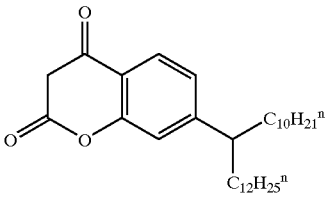
B-19
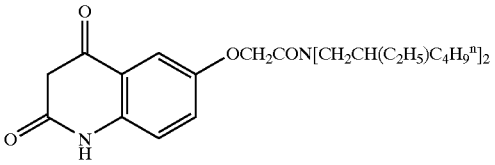
B-20
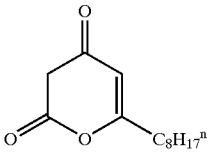
B-21
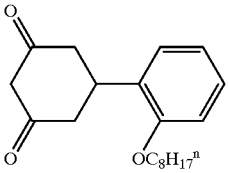
B-22
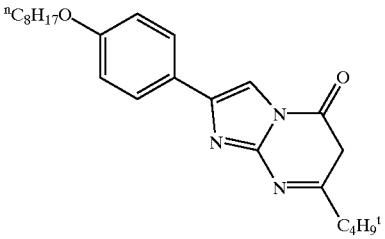

-continued

B-23

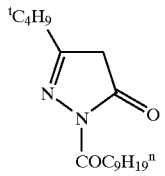

B-24

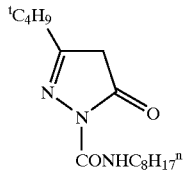

B-25

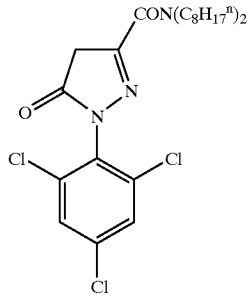

B-26

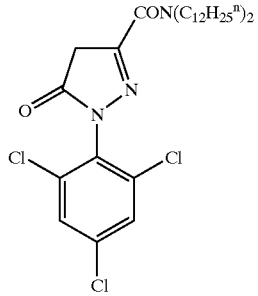

B-27

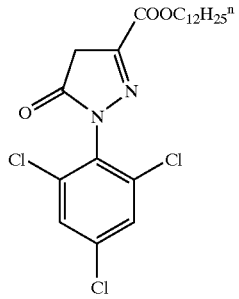

B-28

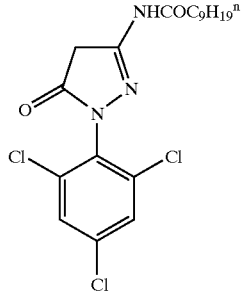

-continued

B-29

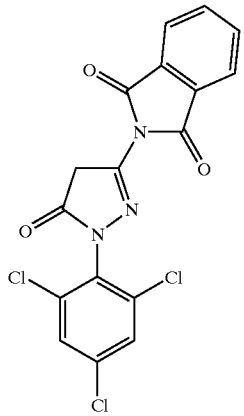

B-30

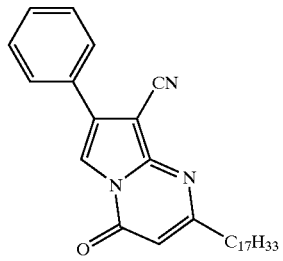

A content of the coupler in the thermosensitive recording material is preferably from 0.1 to 30 parts by weight based on one part by weight of the diazonium salt compound.

In the thermosensitive recording material according to the invention, a combination of an electron-donating dye precursor with an electron-accepting compound (a leuco-based color former) can be used, in addition to the diazonium salt compound and the coupler (diazo-based color former). For example, in a thermosensitive recording material having plural thermosensitive recording layers on a support, at least one layer thereof may be constituted as a layer containing a leuco-based color former.

Electron-Donating Dye Precursor:

Examples of the electron-donating dye precursor include triarylmethane-based compounds, diphenylmethane-based compounds, thiazine-based compounds, xanthene-based compounds, and spiropyran-based compounds. Of these, are preferable triarylmethane-based compounds and xanthene-based compounds from the standpoint of high color development density.

Specific examples include 3,3-bis(p-dimethylaminophenyl)-6-dimethylaminophthalide (i.e., Crystal Violet Lactone), 3,3-bis(p-dimethylamino)phthalide, 3-(p-dimethylaminophenyl)-3-(1,3-dimethylindol-3-yl) phthalide, 3-(p-dimethylaminophenyl)-3-(2-methylindol-3-yl)phthalide, 3-(o-methyl-p-diethylaminophenyl)-3-(2-methylindol-3-yl)phthalide, 4,4'-bis(dimethylamino) benzhydrinbenzyl ether, N-halophenyl leucoauramines, N-2,4,5-trichlorophenyl leucoauramine, Rhodamine B-anilinolactam, Rhodamine (p-nitroanilino)lactam, Rhodamine β-(p-chloroanilino)lactam, 2-benzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-anilino-3-methyl-6-isoamylethylaminofluoran, 2-(o-chloroanilino)-6-diethylaminofluoran, 2-octylamino-6-diethylaminofluoran, 2-ethoxyethylamino-3-chloro-2-diethylaminofluoran, 2-anilino-3-chloro-6-diethylaminofluoran, benzoyl leucomethylene blue, pnitrobenzyl leucomethylene blue, 3-methyl-spirodinaphthopyran, 3-ethyl-spiro-dinaphthopyran, 3,3-dichloro-spiro-dinaphthopyran, 3-benzyl-spiro-naphthopyran, and 3-propyl-spiro-dibenzopyran.

An applied amount of the electron-donating dye precursor is preferably from 0.1 to 1 g/m$^2$ in the thermosensitive recording layer for the same reason as in the case of the diazonium salt compound as described above.

Electron-Accepting Compound:

Examples of the electron-accepting compound include phenol derivatives, salicylic acid derivatives, and hydroxybenzoic acid esters. Of these, are preferable bisphenols and hydroxybenzoic acid esters.

Specific examples include 2,2-bis(p-hydroxyphenyl)-propane (i.e., bisphenol A), 4,4'-(p-phenylenediisopropylidene)diphenyl (i.e., bisphenol P), 2,2-bis(p-hydroxyphenyl)pentane, 2,2-bis(p-hydroxyphenyl) ethane, 2,2-bis(p-hydroxyphenyl)butane, 2,2-bis(4'-hydroxy-3',5'-dichlorophenyl)propane, 1,1-(p-hydroxyphenyl)cyclohexane, 1,1-(p-hydroxyphenyl) propane, 1,1-(p-hydroxyphenyl)pentane, 1,1-(p-hydroxyphenyl)-2-ethylhexane, 3,5-di(α-methylbenzyl) salicylic acid and polyvalent metal salts thereof, 3,5-di(tert-butyl)salicylic acid and polyvalent metal salts thereof, 3-α, α-dimethylbenzylsalicyclic acid and polyvalent metal salts thereof, butyl p-hydroxybenzoate, benzyl phydroxybenzoate, 2-ethylhexyl p-hydroxybenzoate, p-phenylphenol, and p-cumylphenol.

A content of the electron-accepting compound in the thermosensitive recording layer is preferably from 0.1 to 30 parts by weight based on one part by weight of the electron-donating dye precursor.

Other Components:

Organic Base:

In the invention, it is preferred to add an organic base for the purpose of promoting the coupling reaction of the diazonium salt compound with the coupler. Preferably, the organic base is contained together with the diazonium salt compound and the coupler in the thermosensitive recording layer, and may be used singly or in admixture of two or more thereof.

As the organic base, are enumerated nitrogen-containing compounds such as tertiary amines, piperidines, piperazines, amidines, formamidines, pyridines, guanidines, and morpholines. Further, are useful those described in JP-B No. 52-46806, JP-A Nos. 62-70082, 57-169745, 60-94381, 57-123086, 58-134901 and 60-49991, JP-B Nos. 2-24916 and 2-28479, and JP-A Nos. 60-165288 and 57-185430.

Of these, are preferable piperazines such as N,N'-bis(3-phenoxy-2-hydroxypropyl)piperazine, N,N'-bis[3-(p-methylphenoxy)-2-hydroxypropyl]piperazine, N,N'-bis[3-(p-methoxyphenoxy)-2-hydroxypropyl]piperazine, N,N'-bis[3-phenylthio-2-hydroxypropyl]piperazine, N,N'-bis[3-(β-naphthoxy)-2-hydroxypropyl]piperazine, N-3-(β-naphthoxy)$_2$-hydroxypropyl-N'-methylpiperazine, and 1,4-bis{[3-(N-methylpiperazino)-2-hydroxy] propyloxy}benzene; morpholines such as N-[3-(β-naphthoxy)-2-hydroxy]propylmorpholine, 1,4-bis(3-morpholino-2-hydroxypropyloxy)benzene, and 1,3-bis(3-morpholino-2-hydroxypropyloxy)benzene; piperizines such as N-(3-phenoxy-2-hydroxypropyl)piperizine and N-dodecylpiperizine; and guanidines such as triphenylguanidine, tricyclohexylguanidine, and dicyclohexylphenylguanidine.

In the case where the organic base is optionally added, a content of the organic base in the thermosensitive recording layer is preferably from 0.1 to 30 parts by weight based on one part by weight of the diazonium salt compound.

Sensitizer:

In addition to the organic base, a sensitizer can be added in the thermosensitive recording layer for the purpose of promoting the color development reaction.

The sensitizer is a substance that increases the color development density or lowers a minimum color development temperature during the heat recording, and makes the diazonium salt compound, the organic base, the coupler, and the like readily react with each other by actions such as lowering the melting point of the coupler, the organic base, or the diazonium salt compound, and lowering the softening point of the capsule wall.

Concretely, low-melting organic compounds having properly an aromatic group and a polar group in the molecule thereof are preferred. Specific examples include benzyl p-benzyloxybenzoate, α-naphthylbenzyl ether, θ-naphthylbenzyl ether, phenyl θ-naphthoate, phenyl α-hydroxy-βnaphthoate, β-naphthol-(p-chlorobenzyl) ether, 1,4-butanediol phenyl ether, 1,4-butanediol-p-methylphenyl ether, 1,4-butanediol-p-ethylphenyl ether, 1,4-butanediol-m-methylphenyl ether, 1-phenoxy-2-(p-tolyloxy)ethane, 1-phenoxy-2-(p-ethylphenoxy)ethane, 1-phenoxy-2-(p-chlorophenoxy)ethane, and p-benzylbiphenyl.

Binder:

As a binder to be used in the thermosensitive recording layer, are enumerated known water-soluble polymeric compounds and latices.

Examples of the water-soluble polymeric compounds include methyl cellulose, carboxymethyl cellulose, hydroxyethyl cellulose, hydroxypropyl cellulose, starch derivatives, casein, gum arabic, gelatin, an ethylene-maleic anhydride copolymer, a styrene-maleic anhydride copolymer, polyvinyl alcohol, epichlorohydrin-modified polyamides, an isobutylene-maleinsalicylic anhydride copolymer, polyacrylic acid, polyacrylic acid amides, and modified products thereof. Examples of the latices include a styrene-butadiene rubber latex, a methyl acrylate-butadiene rubber latex, and a vinyl acetate emulsion.

Pigment:

A pigment may be contained in the thermosensitive recording layer for the purpose of regulating the hue.

As the pigment, any known pigments can be used irrespective of organic or inorganic ones. Examples include kaolin, calcined kaolin, talc, agalmatolite, diatomaceous earth, calcium carbonate, aluminum hydroxide, magnesium hydroxide, zinc oxide, lithopone, amorphous silica, colloidal silica, calcined gypsum, silica, magnesium carbonate, titanium oxide, alumina, barium carbonate, barium sulfate, mica, microballoon, urea-formalin fillers, polyester particles, and cellulose fillers.

Antioxidant and So On:

It is also preferred to use the known antioxidants as described below and so on for the purpose of enhancing fastnesses of the color developed images to light and heat, or reducing yellowing of non-printed areas (non-image areas) by light after fixing.

As the antioxidant, can be enumerated those described in EP-A Nos. 223,739, 309,401, 309,402, 310,551, 310,552 and 459,416, GP-A No. 3,435,443, JP-A Nos. 54-48535, 62-262047, 63-113536, 63-163351, 2-262654, 2-71262, 3-121449, 5-61166 and 5-119449, and U.S. Pat. Nos. 4,814,262 and 4,980,275.

In the invention, there are no particular limitations on the use mode of the diazonium salt compound, the coupler which thermally reacts with the diazonium salt compound to make it undergo color development, and other components including the organic base and the sensitizer, as well as the electron-donating dye precursor and the electron-accepting compound. Examples include (1) a method of use after solid dispersion, (2) a method of use after emulsification and dispersion, (3) a method of use after polymer dispersion, (4) a method of use after latex dispersion, and (5) a method of utilizing micro-encapsulation. Especially, in the color development system (1) utilizing the reaction between the diazonium salt compound and the coupler, a mode in which the diazonium salt compound is micro-encapsulated is preferred; and in the color development system (2) utilizing the reaction between the electron-donating dye precursor and the electron-accepting compound, a mode in which the electron-donating dye precursor is micro-encapsulated is preferred.

Production Method of Microcapsule:

In the invention, it is preferred that at least one of the diazonium salt compound and the electron-donating dye precursor is encapsulated in a microcapsule from the standpoint of enhancing the preservability of the thermosensitive recording material.

As the method of micro-encapsulating the color development components, are useful the conventionally known methods. For example, is suitably employed an interfacial polymerization method in which an oil phase prepared by dissolving or dispersing the diazonium salt compound (and the electron-donating dye precursor) as one of the color development components in a sparingly water-soluble or water-insoluble organic solvent is mixed with an aqueous phase having a water-soluble polymer dissolved therein, and the mixture is emulsified and dispersed by means of a homogenizer, etc. and then heated to cause a polymer forming reaction on its oil droplet interface, thereby forming a microcapsule wall of the polymeric substance. According to the interfacial polymerization method, it is possible to form capsules having a uniform particle size within a short period of time to obtain a recording material having superior fresh preservability.

Examples of the organic solvent include low-boiling co-solvents such as acetic acid esters, methylene chloride, and cyclohexanone, and/or phosphoric acid esters, phthalic acid esters, acrylic acid esters, methacrylic acid esters, other carboxylic acid esters, fatty acid amides, alkylated biphenyls, alkylated terphenyls, alkylated naphthalenes, diarylethanes, chlorinated paraffins, alcohol-based solvents, phenol-based solvents, ether-based solvents, monoolefinic solvents, and epoxy-based solvents.

Specific examples include high-boiling solvents such as tricresyl phosphate, trioctyl phosphate, octyldiphenyl phosphate, tricyclohexyl phosphate, dibutyl phthalate, dioctyl phthalate, phthalic acid dilaurate, dicyclohexyl phthalate, olefin acid butyl, diethylene glycol benzoate, dioctyl sebacate, dibutyl sebacate, dioctyl adipate, trioctyl trimellitate, acetyltriethyl citrate, octyl maleate, dibutyl maleate, isoamylbiphenyl, chlorinated paraffins, diisopropylnaphthalene, 1,1'-ditolylethane, 2,4-di-tert-amylphenol, N,N-dibutyl-2-butoxy-5-tert-octylaniline, 2-ethylhexyl hydroxybenzoate, and polyethylene glycol.

Of these, are particularly preferable alcohol-based solvents, phosphoric acid ester-based solvents, carboxylic acid ester-based solvents, alkylated biphenyls, alkylated terphenyls, alkylated napthalenes, and diarylethanes.

In addition, a carbonization inhibitor such as hindered phenols and hindered amines may be added to the high-boiling solvent. Especially, those having an unsaturated fatty acid are desired as the high-boiling solvent, and α-methylstyrene dimmers are enumerated. Examples of the α-methylstyrene dimmers include "MSD100" manufactured by Mitsui Toatsu Chemicals, Inc.

As the water-soluble polymers, are enumerated water-soluble polymers such as polyvinyl alcohol. Examples include polyvinyl alcohol, silanol-modified polyvinyl alcohol, carboxy-modified polyvinyl alcohol, amino-modified polyvinyl alcohol, itaconic acid-modified polyvinyl alcohol, a styrene-maleic anhydride copolymer, a butadiene-maleic anhydride copolymer, an ethylene-maleic anhydride copolymer, an isobutylene-maleic anhydride copolymer, polyacrylamide, polystyrenesulfonic acid, polyvinylpyrrolidone, an ethylene-acrylic acid copolymer, and gelatin. Of these, is preferable carboxy-modified polyvinyl alcohol.

The water-soluble polymer can be used in combination with an emulsion or latex of a hydrophobic polymer. Examples of the emulsion or latex include a styrene-butadiene copolymer, a carboxy-modified styrene-butadiene copolymer, and an acrylonitrile-butadiene copolymer. At this time, the conventionally known surfactants and the like may be added, if desired.

Examples of the polymeric substance constituting the microcapsule wall include polyurethane resins, polyurea resins, polyamide resins, polyester resins, polycarbonate resins, aminoaldehyde resins, melamine resins, polystyrene resins, styrene-acrylate copolymer resins, styrenemethacrylate copolymer resins, gelatin, and polyvinylalcohol. Of these, are particularly preferable polyurethane/polyurea resins.

For example, in the case where a polyurethane/polyurea resin is used as a capsule wall material, a microcapsule wall precursor such as polyhydric isocyanates is encapsulated and mixed in an oil medium (oil phase) as a core substance; a second substance (such as polyols and polyamines) which will react with the microcapsule wall precursor to form a microcapsule wall is further mixed in a water-soluble polymer aqueous solution (aqueous phase); the oil phase is emulsified and dispersed in the aqueous phase; and the dispersion is heated to generate a polymer forming reaction on an oil droplet interface, whereby the microcapsule wall can be formed.

Specific examples of the polyhydric isocyanates will be given below, but it should not be construed that the invention is limited thereto. That is, the examples include diisocyanates such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-diphenylmethane-4,4'-diisocyanate, xylene-1,4-diisocyanate, 4,4'-diphenylpropane diisocyanate, trimethylene diisocyanate, hexamethylene diisocyanate, propylene-1,2-diicocyanate, butylene-1,2-diisocyanate, cyclohexylene-1,2-diisocyanate, and cyclohexylene-1,4-diisocyanate; triisocyanates such as 4,4',4"-triphenylmethane triisocyanate and toluene-2,4,6-triisocynate; tetraisocyanates such as 4,4'-dimethylphenylmethane-2,21,5,5'-tetraisocyanate; and isocyanate prepolymers such as an adduct of hexamethylene diisocyanate and trimethylolpropane, an adduct of 2,4-tolylene diisocyanate and trimethylolpropane, an adduct of xylylene diisocyanate and trimethylolpropane, and an adduct of tolylene diisocyanate and hexanetriol.

If desired, these polyhydric polyisocyanates may be used in admixture of two or more thereof. Of these, are particularly preferable those having three or more isocyanate groups in the molecule.

In the micro-encapsulation method, the same organic solvents as those described above can be used as the organic solvent for dissolving the coupler (and the electron-accepting compound), the organic base, other components such as the sensitizer, and the microcapsule wall precursor and the second substance which will react with the microcapsule wall precursor.

A particle size of the microcapsule is preferably from 0.1 to 1.0 μm, and more preferably from 0.2 to 0.7 μm.

Specific constitutional embodiments of the color recording material will be described below.

The thermosensitive recording material according to the invention may be any of a monochromatic thermosensitive recording material comprising a single layer of a thermosensitive recording layer on a support and a color thermosensitive recording material having a laminate structure comprising a plurality of monochromatic recording layers on a support. As the color thermosensitive recording material, is preferable an embodiment in which at least one layer constituting the thermosensitive recording layer is a light fixing type recording layer containing a diazonium salt compound and a coupler which reacts with the diazonium salt compound to form a color.

Especially, in the case of a full-color thermosensitive recording layer including cyan, yellow and magenta, is preferable a thermosensitive recording material of a mode in which all of the three layers on the support are constituted of a diazo-based color former, or of a mode in which the first thermosensitive recording layer near the support is constituted of a leuco-based color former containing an electron-donating dye precursor and an electron-accepting compound, and the second and third layers are constituted of a diazo-based color former.

For example, the thermosensitive recording material according to the invention may be constituted according to the following modes (a) to (c).

Specifically, examples include:

(a) a recording material having a recording layer comprising a laminate of a light fixing type recording layer containing a diazonium salt compound having a maximum absorption wavelength of 360±20 nm and a coupler which reacts with the diazonium salt compound to form a color (i.e., a first recording layer (layer A)) and a light fixing type recording layer containing a diazonium salt compound having a maximum absorption wavelength of 400±20 nm and a coupler which reacts with the diazonium salt compound to form a color (i.e., a second recording layer (layer B)) on a support, and having optionally a light transmittance regulatory layer and a protective layer on the support;

(b) a recording material having a recording layer comprising a laminate of a recording layer containing an electron-donating dye precursor and an electron-accepting compound (i.e., a first recording layer (layer A)), a light fixing type recording layer containing a diazonium salt compound having a maximum absorption wavelength of 360±20 nm and a coupler which reacts with the diazonium salt compound to form a color (i.e., a second recording layer (layer B)), and a light fixing type recording layer containing a diazonium salt compound having a maximum absorption wavelength of 400 ±20 nm and a coupler which reacts with the diazonium salt compound to form a color (i.e., a third recording layer (layer C)) in that order on a support, and having optionally a light transmittance regulatory layer and a protective layer on the support; and (c) a recording material having a recording layer comprising a laminate of a light fixing type recording layer containing a diazonium salt compound having a maximum absorption wavelength of 340±20 nm and a coupler which undergoes a color formation reaction with the diazonium salt compound (i.e., a first recording layer (layer A)), a light fixing type recording layer containing a diazonium salt compound having a maximum absorption wavelength of 360±20 nm and a coupler which reacts with the diazonium salt compound to form a color (i.e., a second recording layer (layer B)), and a light fixing type recording layer containing a diazonium salt compound having a maximum absorption wavelength of 400 ±20 nm and a coupler which reacts with the diazonium salt compound to form a color (i.e., a third recording layer (layer C)) in that order on a support, and having optionally a light transmittance regulatory layer and a protective layer on the support.

The color recording method will be hereunder described according to the above-described mode (b) or (c).

First of all, the third recording layer (layer C) is heated to subject the diazonium salt and the coupler contained in the layer to color development. Next, the resulting layer is irradiated with light having a wavelength of 400±20 nm to decompose the unreacted diazonium salt compound contained in the layer C and undergo light fixing, and heat sufficient for undergoing color development of the second recording layer (layer B) is applied to subject the diazonium salt compound and the coupler contained in the layer B to color development. At this time, though the layer C is also strongly heated at the same time, since the diazonium salt compound is already decomposed (to undergo light fixing), and its color development ability is lost, the layer C does not undergo color development. Further, irradiation with light having a wavelength of 360±20 nm is carried out to decompose the diazonium salt compound contained in the layer B and undergo light fixing, and finally, heat sufficient for undergoing color development of the first recording layer (layer A) is applied to undergo color development. At this time, though the recording layers of the layer C and the layer B are also strongly heated at the same time, since the diazonium salt compound is already decomposed, and its color development ability is lost, the layer C and the layer B do not undergo color development.

With respect to the lamination order of the respective layers, when a yellow layer having a low visibility is positioned as a lowest layer, influences on the image quality caused by the roughness on the support surface can be reduced, and such is especially useful in the case where it is intended to enhance the image quality.

In the case where all of the recording layers (the layers A, B and C) are a diazo-based recording layer, it is necessary to subject the layers A and B to light fixing after the color development. But, as to the layer C in which image recording is finally carried out, it is not always necessary to undergo light fixing. However, it is preferred to undergo light fixing from the standpoint of enhancement of preservability of the formed images.

As a light source to be used for light fixing, it can be properly chosen from the known light sources. Examples include various fluorescent lamps, xenon lamps, and mercury vapor lamps. It is preferred to use light sources, whose light emission spectrum is substantially coincident with an absorption spectrum of the diazonium salt compound used in the recording material, from the standpoint of undergoing light fixing with a high efficiency.

Other Layers:

In the thermosensitive recording material according to the invention, is preferable a mode in which in addition to a single or plural thermosensitive recording layers, a light transmittance regulatory layer and a protective layer are provided on the support.

(Light Transmittance Regulatory Layer)

The light transmittance regulatory layer contains a ultraviolet absorber precursor. Since the ultraviolet absorber precursor does not function as a ultraviolet absorber before irradiation of light having a wavelength region necessary for fixing, it has a high light transmittance. During fixing the light fixing type thermosensitive recording layer, the ultraviolet absorb er precursor transmits light having a wavelength region necessary for fixing and has a high transmittance of visible rays. Thus, it does not adversely affect fixing of the thermosensitive recording layer. Preferably, the ultraviolet absorber precursor is encapsulated in a microcapsule.

As the compound to be contained in the light transmittance regulatory layer, are enumerated the compounds described in JP-A No. 9-1928.

After completion of the irradiation with light having a wavelength region necessary for fixing by the light irradiation of the thermosensitive recording layer, the ultraviolet absorber precursor functions as a ultraviolet absorber upon reaction with light or heat. The ultraviolet absorber absorbs a major part of the light having a wavelength region necessary for fixing in the ultraviolet region, whereby its transmittance becomes low, and light fastness of the thermosensitive recording layer increases. However, since the ultraviolet absorber does not have an absorption effect of visible rays, the transmittance of visible rays does not substantially change.

At least one light transmittance regulatory layer can be provided in the thermosensitive recording material. Most preferably, the light transmittance regulatory layer is formed between the thermosensitive recording layer and the outermost protective layer. But, the light transmittance regulatory layer may be combined with the protective layer. The characteristics of the light transmittance regulatory layer can be arbitrarily chosen according to the characteristics of the thermosensitive recording layer.

A coating liquid for forming the light transmittance regulatory layer (coating liquid for light transmittance regulatory layer) is obtained by mixing the above-described respective components. The light transmittance regulatory layer can be formed by applying the coating liquid for light transmittance regulatory layer by the known application method using, for example, a bar coater, an air knife coater, a blade coater, or a curtain coater. The light transmittance regulatory layer may be formed by simultaneous application with the thermosensitive recording layer and the like, or may be formed by applying a coating liquid for forming the thermosensitive recording layer, once drying the thermosensitive recording layer, and then applying and forming the coating liquid for light transmittance regulatory layer on the resulting thermosensitive recording layer.

(Protective Layer)

The protective layer contains a pigment, a lubricant, a surfactant, a dispersing agent, a fluorescent brightener, a metallic soap, a hardener, a ultraviolet absorber, a crosslinking agent, etc. in addition to a binder.

The binder and the pigment can be properly chosen and used from the water-soluble binder and the pigment that can be used in the back coat layer as described above, respectively. As other useful binders, are enumerated synthetic rubber latices and synthetic resin emulsions, including a styrene-butadiene rubber latex, an acrylonitrile-butadiene rubber latex, a methyl.acrylate-butadiene rubber latex, and a vinyl acetate emulsion.

A content of the binder is preferably from 10 to 500% by weight, and more preferably from 50 to 400% by weight to the pigment in the protective layer.

For the purpose of further enhancing the water resistance, it is effective to use a crosslinking agent in combination with a catalyst for promoting its reaction. Examples of the crosslinking agent include epoxy compounds, blocked isocyanates, vinyl sulfone compounds, aldehyde compounds, methylol compounds, boric acid, carboxylic anhydrides, silane compounds, chelate compounds, and halides. Of these, are preferable those capable of regulating a pH of the coating liquid for forming the protective layer at from 6.0 to 7.5. As the catalyst, are enumerated known acids and metal salts. Of these, are preferable those capable of regulating a pH of the coating liquid for forming the protective layer at from 6.0 to 7.5.

Examples of the lubricant that can be suitably used include zinc stearate, calcium stearate, paraffin waxes, and polyethylene waxes.

As the surfactant, are enumerated those capable of forming uniformly the protective layer on the thermosensitive recording layer, including sulfosuccinic acid-based alkali metal salts and fluorine-containing surfactants. Specific examples include sodium salts and ammonium salts of di-(2-ethylhexyl)sulfosuccinic acid and di-(n-hexyl) sulfosuccinic acid.

The coating liquid for forming the protective layer (coating liquid for protective layer) is obtained by mixing the above-described respective components. If desired, a releasing agent, a wax, a water repellant, etc. may be further added thereto.

The thermosensitive recording material according to the invention can be formed by applying the coating liquid for protective layer on the thermosensitive recording layer formed on the support by the known application method. As the known application method, are enumerated those using, for example, a bar coater, an air knife coater, a blade coater, or a curtain coater.

A dry applied amount of the protective layer is preferably from 0.2 to 7 g/m$^2$, and more preferably from 1 to 4 g/m$^2$. When the dry applied amount of the protective layer is less than 0.2 g/m$^2$, the water resistance may not be kept, whereas when it exceeds 7 g/m$^2$, the heat sensitivity may possibly be remarkably lowered. After the application and formation of the protective layer, a calender processing may be optionally carried out.

(Interlayer)

In the case where plural thermosensitive recording layers are laminated, it is preferred that an interlayer is provided between the respective thermosensitive recording layers. The interlayer can contain a pigment, a lubricant, a surfactant, a dispersing agent, a fluorescent brightener, a metallic soap, a ultraviolet absorber, etc. in addition to various binders, like the protective layer. As the binder, the same binders as in the protective layer can be used.

(Support)

Examples of the support include polyester films such as a polyethylene terephthalate film and a polybutylene terephthalate film; cellulose derivative films such as a cellulose triacetate film; polyolefin films such as a polystyrene film, a polypropylene film, and a polyethylene film; synthetic polymer films such as a polyimide film, a polyvinyl chloride film, a polyvinylidene chloride film, a polyacrylic acid copolymer film, and a polycarbonate film; papers; synthetic papers; and papers having a plastic resin layer.

The support can be used singly or in a laminated state.

As the paper having a plastic resin layer, are desired base papers having a layer containing a thermoplastic resin formed on both surfaces thereof, or at least the surface in the side at which the thermosensitive recording layer is provided. Examples of the support include (1) base papers having a thermoplastic resin melt extruded and coated thereon; (2) base papers having a thermoplastic resin melt extruded and coated thereon and additionally a gas barrier layer coated on the thermoplastic resin; (3) base papers having a lowly oxygen-permeable plastic film adhered thereto; (4) base papers having a plastic film adhered thereto and additionally a thermoplastic resin melt extruded and coated on the plastic film; and (5) base papers having a thermoplastic resin melt extruded and coated thereon and additionally a plastic film adhered to the thermoplastic resin.

Preferred examples of the thermoplastic resin that is melt extruded and coated on the base paper include olefin resins such as α-olefin homopolymers such as polyethylene and polypropylene, and mixtures of these various polymers; and random copolymers of ethylene and vinyl alcohol. The polyethylene includes LDDE (low-density polyethylene), HDPE (high-density polyethylene), and L-LDPE (linear low-density polyethylene).

As the method for laminating the plastic film on base paper, the known lamination methods as described in, for example, "Shin Ramineto Kako Binran (New Lamination Processing Handbook)" edited by the Processing Technology Research Institute can be properly chosen. Of these, are preferable so-called dry lamination, solvent-free dry lamination, dry lamination using an electron beam- or ultraviolet light-curable resin, and hot dry lamination.

Of these supports, are preferable paper supports in which polyethylene is laminated on at least one surface of base paper, generally on the surface in the side at which the thermosensitive recording layer is formed. Paper supports in which polyethylene is laminated on the both surfaces of base paper are more preferable. In this case, polyethylene is laminated on the surface of base paper in the side at which the thermosensitive recording layer is formed for the purpose of enhancing the flatness, and is laminated on the opposite surface of the base paper for the purpose of regulating the curling balance.

The synthetic polymer film may be colored into an arbitrary hue. Examples of the method of coloring the polymer film include (1) a method in which a dye is previously kneaded with a resin prior to the film formation, and the mixture is then formed into a film state, and (2) a method in which a coating liquid having a dye dissolved in a proper solvent is prepared and then applied on a transparent colorless resin film by the known application method such as a gravure coating method, a roller coating method, and a wire coating method, followed by drying. Of these, is preferable a method in which a polyester resin such as polyethylene terephthalate and polyethylene naphthalate, having a blue dye kneaded therewith is formed into a film state and then subjected to heat-resisting processing, elongation processing and antistatic processing.

A thickness of the support is preferably from 25 to 300 μm, and more preferably from 50 to 250 μm.

The thermosensitive recording layer, the protective layer, the light transmittance regulatory layer, the interlayer and so on can be formed by applying the respective coating liquids on the support by the known application method such as a blade coating method, an air knife coating method, a gravure coating method, a roll coating method, a spray coating method, a dip coating method, and a bar coating method, followed by drying.

EXAMPLES

The invention will be described below with reference to the Examples, but it should not be construed that the invention is limited thereto. In the following Examples, "parts" and "%" are "parts by weight" and "% by weight", respectively. Further, the diazonium salt compound will be sometimes simply referred to as "diazonium compound".

Preparation of Phthalated Gelatin Solution:

32 parts of phthalated gelatin (trade name: MGP GELATIN, manufactured by Nippi Collagen Co., Ltd.), 0.9143 parts of 1,2-benzothiazolin-3-one (a 3.5% methanol solution, manufactured by Daito Chemix Corporation), and 367.1 parts of ion-exchanged water were mixed and then dissolved at 40° C., to obtain a phthalated gelatin aqueous solution.

Preparation of Alkali-Processed Gelatin Solution:

25.5 parts of alkali-processed low-ion gelatin (trade name: #750 GELATIN, manufactured by Nitta Gelatin Inc.), 0.7286 parts of 1,2-benzothiazolin-3-one (3.5% methanol solution, manufactured by Daito Chemix Corporation), 0.153 parts of calcium hydroxide, and 143.6 parts of ion-exchanged water were mixed and then dissolved at 50° C., to obtain a gelatin aqueous solution for preparation of emulsion.

(1) Preparation of Yellow Thermosensitive Recording Layer Liquid:

Preparation of Diazonium Salt Compound-Encapsulating Microcapsule Liquid (a);

To 24.2 parts of ethyl acetate, were added 2.2 parts of the following diazonium salt compound (A) (maximum absorption wavelength: 420 nm), 2.2 parts of the following diazonium salt compound (B) (maximum absorption wavelength: 420 nm), 7.2 parts of monoisopropylbiphenyl, 7.2 parts of diphenyl phthalate, and 0.4 parts of diphenyl-(2,4,6-trimethylbenzoyl)phosphine oxide (trade name: LUCIRIN TPO, manufactured by BASF Japan Ltd.), and the mixture was heated and uniformly dissolved at 40° C. To the mixed solution, was added 8.6 parts of a mixture of a xylylene diisocyanate/trimethyloylpropane adduct and a xylylene diisocyanate/bisphenol A adduct (trade name: TAKENATE D119N (50% by weight ethyl acetate solution), manufactured by Takeda Chemical Industries, Ltd.) as a capsule wall material, and the mixture was uniformly stirred to obtain a mixed liquid (I).

Diazonium salt compound (A)

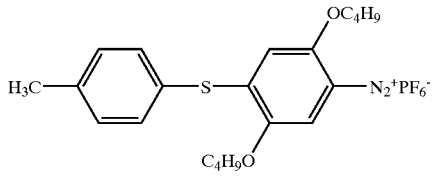

Diazonium salt compound (B)

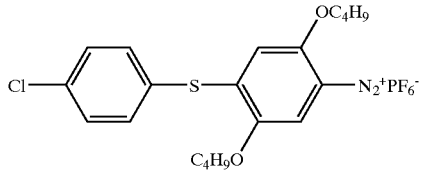

Separately, 16.3 parts of ion-exchanged water and 0.34 parts of surfactant (trade name: SCRAPH AG-8, 50% by weight, manufactured by Nippon Fine Chemical Co., Ltd.) were added to 58.6 of the foregoing aqueous phthalated gelatin solution, to obtain a mixed liquid (II).

The mixed liquid (I) was added to the mixed liquid (II) and the mixture was emulsified and dispersed at 40° C. using a homogenizer (manufactured by Nippon Seiki Seisakusho K.K.). 20 parts of water was added to the obtained emulsion to make it uniform, and the uniform mixture was subjected to an encapsulation reaction with stirring at 40° C. for 3 hours while removing the ethyl acetate. Thereafter, 4.1 parts of an ion exchange resin, AMBERLITE IRA68 (trade name: manufactured by Organo Corporation) and 8.2 parts of an ion exchange resin, AMBERLITE IRC50 (trade name: manufactured by Organo Corporation) were added to the reaction mixture and the mixture was stirred for an additional one hour. Then, the ion exchange resins were removed by filtration, and the concentration of the capsule liquid was regulated such that the solids content became 20.0%, to obtain a diazonium salt compound-encapsulating microcapsule liquid (a). A particle size of the obtained microcapsule was measured using LA-700 (trade name, manufactured by Horiba, Ltd.). As a result, it was 0.42 μm in terms of median diameter.

Preparation of Coupler Compound Emulsion (a):

In 33.0 parts of ethyl acetate, were dissolved 13.5 parts of the following coupler compound (C), 13.5 parts of triphenyl guanidine (manufactured by Hodogaya Chemical Co., Ltd.), 20.8 parts of 4,4'-(m-phenylenediisopropylidene)diphenol (trade name: BISPHENOL M, manufactured by Mitsui Petrochemical Industries, Ltd.), 3.3 parts of 3,3,3',3'-tetramethyl-5,5',6,6'-tetra(1-propyloxy)-1,1' spirobisindane, 13.6 parts of 4-(2-ethylhexyloxy)benzenesulfonamide (manufactured by Manac Incorporated), 6.8 parts of 4-n-pentyloxybenzenesulfonamide (manufactured by Manac Incorporated), and 4.2 parts of calcium dodecylbenzenesulfonate (trade name: PYONINE A-41-C, 70% methanol solution, manufactured by Takemoto Oil and Fat Co., Ltd.), to obtain a mixed liquid (III).

Coupler compound (C)

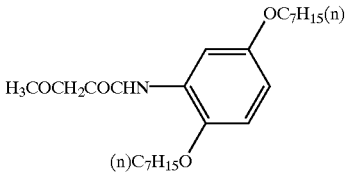

Separately, 107.3 parts of ion-exchanged water was mixed with 206.3 parts of the foregoing alkali-processed gelatin aqueous solution, to obtain a mixed liquid (IV).

The mixed liquid (III) was added to the mixed liquid (IV), and the mixture was emulsified and dispersed at 40° C. using a homogenizer (manufactured by Nippon Seiki Seisakusho K.K.). The obtained coupler compound emulsion was heated in vacuo to remove the ethyl acetate, and the concentration of the emulsion was regulated such that the solids content became 26.5% by weight. A particle size of the obtained coupler compound emulsion was measured using LA-700 (trade name, manufactured by Horiba, Ltd.). As a result, it was 0.25 μm in terms of median diameter.

In addition, to 100 parts of the foregoing coupler compound emulsion, was added 9 parts of an SBR latex (trade name: SN-307, 48% liquid, manufactured by Sumika ABS Latex Co., Ltd.) whose concentration had been regulated to be 26.5%, and the mixture was uniformly stirred to obtain a coupler compound emulsion (a).

Preparation of Coating Liquid (a):

The diazonium salt compound-encapsulating microcapsule liquid (a) and the coupler compound emulsion (a) were mixed with each other such that a weight ratio of the coupler compound to the diazonium compound to be contained became 2/1, to obtain a coating liquid (a) for thermosensitive recording layer.

(2) Preparation of Magenta Thermosensitive Recording Layer Liquid:

Preparation of Diazonium Salt Compound-Encapsulating Microcapsule Liquid (b):

To 15.1 parts of ethyl acetate, were added 3.3 parts of the following diazonium salt compound (D) (maximum absorption wavelength: 420 nm), 3.3 parts of diphenyl phthalate, 3.3 parts of phenyl 2-benzoyloxybenzoate, 4.2 parts of the following compound (E) (trade name: LIGHT ESTER TMP, manufactured by Kyoeisha Chemical Co., Ltd.), and 0.1 parts of calcium dodecylbenzenesulfonate (trade name: PYONINE A41-C, 70% methanol solution, manufactured by Takemoto Oil and Fat Co., Ltd.), and the mixture was heated and uniformly dissolved. To the mixed solution, were added 2.5 parts of a mixture of a xylylene diisocyanate/trimethyloylpropane adduct and a xylylene diisocyanate/bisphenol A adduct (trade name: TAKENATE D119N (50% by weight ethyl acetate solution), manufactured by Takeda Chemical Industries, Ltd.) and 6.8 parts of a xylylene diisocyanate/trimethylolpropane adduct (trade name: TAKENATE D110N (75% by weight ethyl acetate solution), manufactured by Takeda Chemical Industries, Ltd.) as capsule wall materials, and the mixture was uniformly stirred to obtain a mixed liquid (V).

Diazonium salt compound (D)

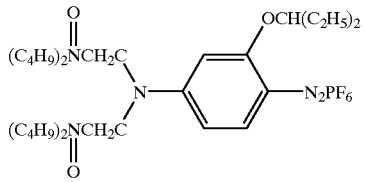

Compound (E)

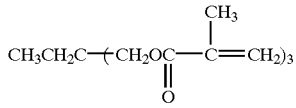

Separately, 21.0 parts of ion-exchanged water was added to and mixed with 55.3 parts of the foregoing phthalated gelatin aqueous solution, to obtain a mixed liquid (VI).

The mixed liquid (V) was added to the mixed liquid (VI), and the mixture was emulsified and dispersed at 40° C. using a homogenizer (manufactured by Nippon Seiki Seisakusho K.K.) 24 parts of water was added to the obtained emulsion to make it uniform, and the uniform mixture was subjected to an encapsulation reaction with stirring at 40° C. for 3 hours while removing the ethyl acetate. Thereafter, 4.1 parts of an ion exchange resin, AMBERLITE IRA68 (trade name: manufactured by Organo corporation) and 8.2 parts of an ion exchange resin, AMBERLITE IRC50 (trade name: manufactured by Organo Corporation) were added to the reaction mixture, and the mixture was stirred for an additional one hour. Then, the ion exchange resins were removed by filtration, and the concentration of the capsule liquid was regulated such that the solids content became 20.0%, to obtain a diazonium salt compound-encapsulating microcapsule liquid (b). A particle size of the obtained microcapsule was measured using LA-700 (trade name, manufactured by Horiba, Ltd.). As a result, it was 0.48 μm in terms of median diameter.

Preparation of Coupler Compound Emulsion (b):

In 36.9 parts of ethyl acetate, were dissolved 15 parts of the following coupler compound (F), 15 parts of triphenyl guanidine (manufactured by Hodogaya Chemical Co., Ltd.), 15 parts of 4,4'-(m-phenylenediisopropylidene)diphenol (trade name: BISPHENOL M, manufactured by Mitsui Petrochemical Industries, Ltd.), 7 parts of 3,3,3',3'-tetramethyl-5,5',6,6'-tetra(1-propyloxy)-1,1'-spirobisindane, 3.5 parts of the following compound (G), 1.7 parts of tricresyl phosphate, 0.8 parts of diethyl maleate, and 4.5 parts of calcium dodecylbenzenesulfonate (trade name: PYONINE A-41-C, 70% methanol solution, manufactured by Takemoto Oil and Fat Co., Ltd.), to obtain a mixed liquid (VIT).

Coupler compound (F)

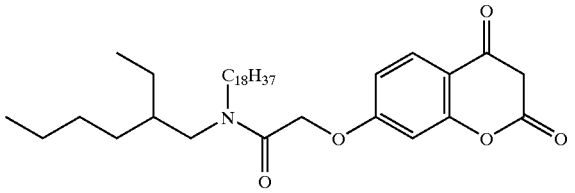

Compound (G)

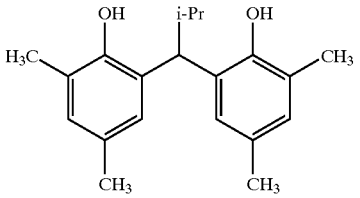

Separately, 107.3 parts of ion-exchanged water was mixed with 206.3 parts of the foregoing alkali-processed gelatin aqueous solution, to obtain a mixed liquid (VIII).

The mixed liquid (VII) was added to the mixed liquid (VIII), and the mixture was emulsified and dispersed at 40° C. using a homogenizer (manufactured by Nippon Seiki Seisakusho K.K.). The obtained coupler compound emulsion was heated in vacuo to remove the ethyl acetate, and the concentration of the emulsion was regulated such that the solids content became 24.5% by weight, to obtain a coupler compound emulsion (b) A particle size of the obtained coupler compound emulsion was measured using LA-700 (trade name, manufactured by Horiba, Ltd.). As a result, it was 0.30 $\mu$m in terms of median diameter.

Preparation of Coating Liquid (b):

The diazonium salt compound-encapsulating microcapsule liquid (b) and the coupler compound emulsion (b) were mixed with each other such that a weight ratio of the coupler compound to the diazonium compound to be contained became 3/1. Further, an aqueous solution (5% by weight) of polystyrenesulfonic acid (partially neutralized with potassium hydroxide) was mixed in an amount of 0.2 parts to 10 parts of the capsule liquid, to obtain a coating liquid (b) for thermosensitive recording layer.

(3) Preparation of Cyan Thermosensitive Recording Layer Liquid:

Preparation of Electron-Donating Dye Precursor-Encapsulating Microcapsule Liquid (c):

To 18.1 parts of ethyl acetate, were added 9 parts of the following electron-donating dye precursor (H), 9 parts of a mixture of 1-methylpropylphenyl-phenylmethane and 1-(1-methylpropylphenyl)-2-phenylethane (trade name: HISOL SAS310, manufactured by Nippon Oil Company, Ltd.), and 9 parts of the following compound (I) (trade name: IRGAPERM 2140, manufactured by Ciba-Geigy AG), and the mixture was heated and uniformly dissolved. To the mixed solution, were added 7.2 parts of an xylylene diisocyanate/trimethylolpropane adduct (trade name: TAKENATE D110N (75% by weight ethyl acetate solution), manufactured by Takeda Chemical Industries, Ltd.) and 5.3 parts of polymethylene polyphenyl polyisocyanate (trade name: MILLIONATE MR-200, manufactured by Nippon Polyurethane Industry Co., Ltd.) as capsule wall materials, and the mixture was uniformly stirred to obtain a mixed liquid (IX).

Electron-donating dye precursor (H)

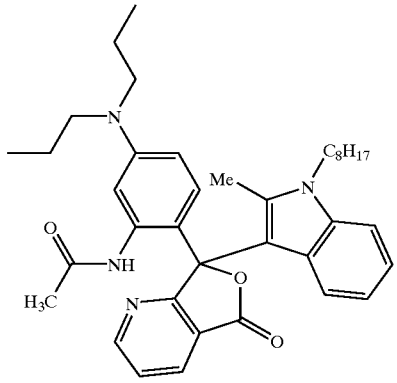

Compound (I)

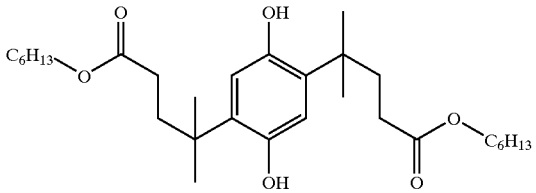

Separately, 9.5 parts of ion-exchanged water, 0.17 parts of surfactant (trade name: SCRAPH AG-8, 50% by weight, manufacture by Nippon Fine Chemical Co., Ltd.), and 4.3 parts of sodium dodecylbenzenesulfonate (10% aqueous solution) were added to and mixed with 28.8 parts of the foregoing phthalated gelatin aqueous solution, to obtain a mixed liquid (X).

The mixed liquid (IX) was added to the mixed liquid (X) and the mixture was emulsified and dispersed at 40° C. using a homogenizer (manufactured by Nippon Seiki Seisakusho K.K.). 50 parts of water and 0.12 parts of tetraethylenepentamine were added to the obtained emulsion to make it uniform, and the uniform mixture was subjected to an encapsulation reaction with stirring at 65° C. for 3 hours while removing the ethyl acetate. Thereafter, the concentration of the capsule liquid was regulated such that the solids content became 33%, to obtain a microcapsule liquid. A particle size of the obtained microcapsule was measured using LA-700 (trade name, manufactured by Horiba, Ltd.). As a result, it was 1.2 $\mu$m in terms of median diameter.

In addition, to 100 parts of the foregoing microcapsule liquid, were added 3.7 parts of a 25% aqueous solution of sodium dodecylbenzenesulfonate (trade name: NEOPELEX F-25, manufactured by Kao Corporation) and a 4,4'-bistriazinylaminostilbene-2,2'-disulfone derivative (trade name: KAYCALL BXNL, manufactured by Nippon Soda Co., Ltd.), and the mixture was uniformly stirred to obtain a microcapsule dispersion (c).

Preparation of Electron-Accepting Compound Dispersion (c):

To 11.3 parts by weight of the foregoing phthalated gelatin aqueous solution, were added 30.1 parts by weight of ion-exchanged water, 15 parts by weight of 4,4'-(m-phenylenediisopropylidene)diphenol (trade name: BISPHENOL P, manufactured by Mitsui Petrochemical Industries, Ltd.), and 3.8 parts by weight of a 2% by weight aqueous solution of sodium 2-ethylhexylsuccinate, and the mixture was dispersed overnight in a ball mill, to obtain a dispersion. This dispersion had a solids content of 26.6% by weight.

To 100 parts by weight of the dispersion, was added 50 parts by weight of the foregoing alkali-processed gelatin aqueous solution, and the mixture was stirred for 30 minutes. Then, ion-exchanged water was added thereto such that the solids content of the dispersion became 23.5%, to obtain an electron-accepting compound dispersion (c).

Preparation of Coating Liquid (c):

The foregoing electron-donating dye precursor-encapsulating microcapsule liquid (c) and the foregoing electron-accepting compound dispersion (c) were mixed with each other such that a weight ratio of the electron-accepting compound to the electron-donating dye precursor became 8/1, to obtain a coating liquid (c).

Preparation of Coating Liquid for Interlayer:

100.0 parts of alkali-processed low-ion gelatin (trade name: #750 GELATIN, manufactured by Nitta Gelatin Inc.), 2.857 parts of 1,2-benzothiazolin-3-one (3.5% methanol solution, manufactured by Daito Chemix Corporation), 0.5 parts of calcium hydroxide, and 521.643 parts of ion-exchanged water were mixed and then dissolved at 50° C., to obtain an aqueous gelatin solution for preparation of interlayer.

10.0 parts of the aqueous gelatin solution for preparation of interlayer, 0.05 parts of sodium (4-nonylphenoxytrioxyethylene)butylsulfonate (2.0% by weight aqueous solution, manufactured by Sankio Chemical Co., Ltd.), 2.5 parts of boric acid (4.0% by weight aqueous solution), 0.19 parts of an aqueous solution (5% by weight) of polystyrenesulfonic acid (partially neutralized with potassium hydroxide), 3.42 parts of a 4% by weight aqueous solution of the following compound (J) (manufactured by Wako Pure Chemical Industries, Ltd.), 1.13 parts of a 4% by weight aqueous solution of the following compound (J') (manufactured by Wako Pure Chemical Industries, Ltd.), and 0.67 parts of ion-exchanged water were mixed with each other, to prepare a coating liquid for interlayer.

Compound (J)

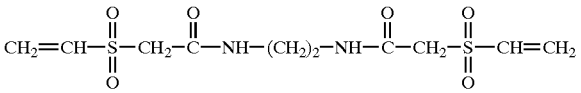

Compound (J')

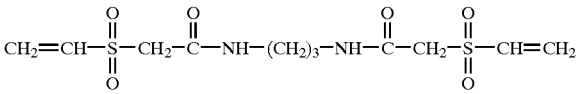

Preparation of Coating Liquid for Light Transmittance Regulatory Layer:

(iii-1) Preparation of Ultraviolet Absorber Precursor Microcapsule Liquid:

In 71 parts of ethyl acetate, were uniformly dissolved 15 parts of [2-allyl-6-(2H-benzotriazol-2-yl)-4-t-octylphenyl] benzenesulfonate as a ultraviolet absorber precursor, 7 parts of 2,2'-t-octylhydroquinone, 1.9 parts of tricresyl phosphate, 5.7 parts of an α-methylstyrene dimmer (trade name: MSD-100, manufactured by Mitsui Chemicals, Inc.), and 0.45 parts of calcium dodecylbenzenesulfonate (trade name: PYONINE A-41-C, 70% methanol solution, manufactured by Takemoto Oil and Fat Co., Ltd.). To the mixed solution, was added 54.7 parts of a xylylene diisocyanate/trimethylolpropane adduct (trade name: TAKENATE D110N (75% by weight ethyl acetate solution), manufactured by Takeda Chemical Industries, Ltd.) as a capsule wall material, and the mixture was uniformly mixed to obtain a ultraviolet absorber precursor mixed liquid (VII).

Separately, 52 parts of itaconic acid-modified polyvinyl alcohol (trade name: KL-318, manufactured by Kuraray Co., Ltd.) was mixed with 8.9 parts of a 30% by weight phosphoric acid aqueous solution and 532.6 parts of ion-exchanged water, to prepare a PVA aqueous solution for ultraviolet absorber precursor microcapsule liquid.

The foregoing ultraviolet absorber precursor mixed liquid (VII) was added to 516.06 parts of the PVA aqueous solution for ultraviolet absorber precursor microcapsule liquid, and the mixture was emulsified and dispersed at 20° C. using a homogenizer (manufactured by Nippon Seiki Seisakusho K.K.). 254.1 parts of ion-exchanged water was added to the obtained emulsion to make it uniform, and the uniform mixture was subjected to an encapsulation reaction with stirring at 40° C. for 3 hours. Thereafter, 94.3 parts of an ion exchange resin, AMBERLITE MB-3 (trade name, manufactured by Organo corporation) was added to the reaction mixture, and the mixture was stirred for an additional one hour. Then, the ion exchange resin was removed by filtration, and the concentration of the capsule liquid was regulated such that the solids content became 13.5%. A particle size of the obtained microcapsule was measured using LA-700 (trade name, manufactured by Horiba, Ltd.). As a result, it was 0.23±0.05 μm in terms of median diameter. 859.1 parts of this capsule liquid was mixed with 2.416 parts of a carboxy-modified styrene-butadiene latex (trade name: SN-307 (48% by weight aqueous solution), manufactured by Sumitomo Naugatack Co., Ltd.) and 39.5 parts of ion-exchanged water, to obtain a ultraviolet absorber precursor microcapsule liquid.

(iii-2) Preparation of Coating Liquid for Light Transmittance Regulatory Layer:

1,000 parts of the foregoing ultraviolet absorber precursor microcapsule liquid, 7.75 parts of a 4% by weight sodium hydroxide aqueous solution, and 73.39 parts of sodium (4-nonylphenoxytrioxyethylene)butylsulfonate (2.0% by weight aqueous solution, manufactured by Sankio Chemical Co., Ltd.) were mixed with each other, to obtain a coating liquid for light transmittance regulatory layer.

Preparation of Coating Liquid for Protective Layer:

(iv-1) Preparation of Polyvinyl Alcohol Solution for Protective Layer:

160 parts of a vinyl alcohol-alkyl vinyl ether copolymer (trade name: EP-130, manufactured by Denki Kagaku Kogyo Kabushiki Kaisha), 8.74 parts of a mixed liquid of sodium alkylsulfonate and polyoxyethylene alkyl ether phosphoric acid ester (trade name: NEOSCORE CM-57 (54% by weight aqueous solution), manufactured by Toho Chemical Industry Co., Ltd.), and 3,832 parts of ion-exchanged water were mixed with each other and then dissolved at 90° C. for one hour, to obtain a uniform polyvinyl alcohol solution for protective layer.

(iv-2) Preparation of Pigment Dispersion for Protective Layer:

8 parts of barium sulfate (trade name: BF-21F, barium sulfate content: 93% or more, manufactured by Sakai Chemical Industry Co., Ltd.) was mixed with 0.2 parts of an anionic special polycarboxylic acid type polymeric activator (trade name: POISE 532A (trade name, (40% by weight aqueous solution) manufactured by Kao Corporation) and 11.8 parts of ion-exchange water, and the mixture was dispersed using DYNO-MILL, to prepare a pigment dispersion for protective layer. A particle size of this dispersion was measured using LA-700 (trade name, manufactured by Horiba, Ltd.). As a result, it was 0.15 μm or less in terms of median diameter.

To 45.6 parts of the barium sulfate dispersion, was added 8.1 parts of colloidal silica (trade name: SNOWTEX 0 (20% by weight aqueous dispersion), manufactured by Nissan Chemical Industries, Ltd.), to obtain a desired dispersion.

(iv-3) Preparation of Matting Agent Dispersion for Protective Layer:

220 parts of wheat starch (trade name: WHEAT STARCH S, manufactured by Shin-Shin Foods Co., Ltd.) was mixed with 3.81 parts of an aqueous dispersion of 1,2-benzothiazolin-3-one (trade name: PROXEL B.D., manufactured by I.C.I.) and 1,976.19 parts of ion-exchanged water and uniformly dispersed to obtain a matting agent dispersion for protective layer.

(iv-4) Preparation of Coating Blend Liquid for Protective Layer:

1,000 parts of the foregoing polyvinyl alcohol solution for protective layer was uniformly mixed with 40 parts of an acetylene glycol-based surfactant (trade name: DYNOL 604, 5% by weight methanol solution, manufactured by Air Products Japan, Inc.), 49.87 parts of the foregoing pigment dispersion for protective layer, 16.65 parts of the foregoing matting agent dispersion for protective layer, and 48.7 parts of a zinc stearate dispersion (trade name: HI-MICRON L111, 20.5% by weight aqueous solution, manufactured by Chukyo Yushi Co., Ltd.), to obtain a coating blend liquid for protective layer.

Subbed Support:

Preparation of Liquid for Subbing Layer:

40 parts of enzymatically decomposed gelatin (mean molecular weight: 10,000, viscosity by the PAGI process: 1.5 Pa.S (15 mP), jerry intensity by the PAGI process: 20 g) was added to 60 parts of ion-exchanged water and dissolved with stirring at 40° C., to prepare a gelatin aqueous solution for subbing layer.

Separately, 8 parts of water-swelling synthetic mica (aspect ratio: 1,000, trade name: SOMASIF ME100, manufactured by CO-OP Chemical Co., Ltd.) and 92 parts of water, and the mixture was wet dispersed in a visco mill, to obtain a mica dispersion having a mean particle size of 2.0 μm. Water was added to the mica dispersion such that the mica concentration became 5% by weight, followed by uniformly mixing to prepare the desired mica dispersion.

To 100 parts of the foregoing 40% by weight gelatin aqueous solution at 40° C., were added 120 parts of water and 556 parts of methanol. After thoroughly stirring and mixing, 208 parts of the foregoing 5% by weight mica dispersion was added to the mixture and thoroughly stirred and mixed. Then, 9.8 parts of a 1.66% by weight polyethylene oxide-based surfactant was added to the mixture. Thereafter, 7.3 parts of a gelatin hardener of an epoxy compound was added while keeping the liquid temperature at 35° C. to 40° C., to prepare a coating liquid for subbing layer (5.7% by weight). There was thus obtained a coating liquid for subbing.

Preparation of Subbed Support:

A wood pulp composed of 50 parts of LBPS and 50 parts of LBPK was beaten to 300 cc of Canadian freeness by a disk refiner. To the beaten wood pulp, were added 0.5 parts of epoxidized behenic acid amide, 1.0 part of anion polyacrylamide, 1.0 part of aluminum sulfate, 0.1 parts of polyamidepolyamine epichlorohydrin, and 0.5 parts of cation polyacrylamide in terms of oven-dry weight ratio to the pulp, and the mixture was subjected to paper making into base paper having a basis weight of 114 g/m$^2$ by a four-drinier machine, followed by calender processing to adjust the thickness of 100 μm.

Next, the both surfaces of the base paper were subjected to corona discharge processing, and polyethylene was coated in a resin thickness of 36 μm on one surface of the base paper using a melt extruder, to form a resin layer comprising a matting surface (this surface being referred to as "back surface"). Next, on the surface opposite to the rein layer-formed surface, was coated polyethylene containing 10% by weight of anatase type titanium dioxide and a trace amount of ultramarine in a resin thickness of 50 μm using a melt extruder, to form a resin layer comprising a glossy surface (this surface being referred to as "front surface"). The polyethylene resin-coated surface of the back surface was subjected to corona discharge processing, and a dispersion of a mixture (1/2 by weight) of aluminum oxide (trade name: ALUMINA SOL 100, manufactured by Nissan Chemical Industries, Ltd.) and silicon dioxide (trade name: SNOWTEX 0, manufactured by Nissan Chemical Industries, Ltd.) in water was applied as an antistatic in a dry weight of 0.2 μm$^2$ on the back surface. Next, the polyethylene resin-coated surface of the front surface was subjected to corona discharge processing, and the foregoing subbing liquid was applied in an applied amount of 0.30 g/m$_2$. There was thus obtained a subbed support.

Application of Respective Coating Liquids for Thermosensitive Recording Layers:

On the subbed support, were simultaneous continuously applied seven layers of the coating liquid (c) for thermosensitive recording layer, the coating liquid for interlayer, the coating liquid (b) for thermosensitive recording layer, the coating liquid for interlayer, the coating liquid (a) for thermosensitive recording layer, the coating liquid for light transmittance regulatory layer, and the coating liquid for protective layer in that order from the lower side. The resultant was dried at 30° C. at a humidity of 30% and then at 40° C. at a humidity of 40%, to obtain a color thermosensitive recording material.

During this time, the application was carried out in a manner in which the applied amount of the coating liquid (a) for thermosensitive recording layer was set up such that the applied amount of the diazonium salt compound (A) contained in the coating liquid became 0.08 g/m$^2$ in terms of solids content applied amount; the applied amount of the coating liquid (b) for thermosensitive recording layer was set up such that the applied amount of the diazonium salt compound (D) contained in the coating liquid became 0.21 g/m$^2$ in terms of solids content; and the applied amount of the coating liquid (c) for thermosensitive recording layer was set up such that the applied amount of the electron-donating dye precursor (H) contained in the coating liquid became 0.4 g/m$^2$ in terms of solids content, respectively.

Further, the application was carried out in a manner in which the applied amount of the coating liquid for interlayer was set up such that the applied amount of solids content between (a) and (b) became 2.5 g/m$^2$, and the applied amount of solids content between (b) and (c) became 3.5 g/m$^2$, respectively; the applied amount of the coating liquid for light transmittance regulatory layer was set up such that the applied amount of solids content became 2.0 g/m$^2$; and the applied amount of the coating liquid for protective layer was set up such that the applied amount of solids content became 1.5 g/m$^2$, respectively.

Example 1

Preparation of Coating Liquid for Outermost Back Layer:

To 100 parts of a 12.5% aqueous solution of polyvinyl alcohol (trade name: PVA105, manufactured by Kuraray Co., Ltd.), was added 20 parts of a dispersion prepared by mixing 24 parts of a 2% aqueous solution of 2-ethylhexyl sulfosuccinate (trade name: RAPISOL B-90, manufactured by NOF Corporation), 13 parts of a synthetic mica dispersion (trade name: SOMASIF MEB-3, manufactured by CO—OP Chemical Co., Ltd.), 100 parts of an aluminum hydroxide dispersion (trade name: HIGILITE H42S, manufactured by Showa Light Metal Co., Ltd.), 1 part of sodium hexametaphosphate, and 150 parts of water and dispersing the mixture in a mean particle size of 0.05 μm by a wet dispersing machine such as a ball mill, and the mixture was stirred. There was thus obtained a coating liquid 1 for outermost back layer containing the synthetic mica, aluminum hydroxide and polyvinyl alcohol.

Preparation of Coating Liquid for Intermediate Back Layer:

300 parts of a 15% alkali-processed gelatin aqueous solution, 100 parts of a 2% aqueous solution of 2-ethylhexyl sulfosuccinate (trade name: RAPISOL B-90, manufactured by NOF Corporation), and 1,800 parts of water were mixed with each other, to obtain a coating liquid for intermediate back layer.

Formation of Back Coat Layer:

On the opposite surface of the front surface of the support, were applied and dried the coating liquid for intermediate back layer and the coating liquid 1 for outermost back layer in that order from the support side such that the applied amount of the solids content after drying became 9 g/m$^2$ and 2.2 g/m$^2$, respectively, to form a back coat layer comprising two layers of the intermediate back layer and the outermost back layer on the support. There was thus obtained a thermosensitive recording material 1.

Example 2

Preparation of Coating Liquid for Outermost Back Layer:

A coating liquid 2 for outermost back layer was obtained in the same manner as in Example 1, except that in Example 1, the amount of the aluminum hydroxide dispersion to be added was changed to 30 parts.

Formation of Back Coat Layer:

A back coat layer was formed in the same manner as in Example 1, except that the coating liquid 1 for outermost layer was replaced by the coating liquid 2 for outermost back layer and that its applied amount was changed to 2.7 g/m$^2$. There was thus obtained a thermosensitive recording material 2.

Example 3

Preparation of Coating Liquid for Outermost Back Layer:

A coating liquid 3 for outermost back layer was obtained in the same manner as in Example 1, except that in Example 1, the amount of the aluminum hydroxide dispersion to be added was changed to 15 parts.

Formation of Back Coat Layer:

A back coat layer was formed in the same manner as in Example 1, except that the coating liquid 1 for outermost layer was replaced by the coating liquid 3 for outermost back layer and that its applied amount was changed to 1.7 g/m$^2$. There was thus obtained a thermosensitive recording material 3.

Example 4

Preparation of Coating Liquid for Outermost Back Layer:

A coating liquid 4 for outermost back layer was obtained in the same manner as in Example 1, except that in Example 1, the mean particle size of the aluminum hydroxide dispersion was changed to 0.8 μm.

Formation of Back Coat Layer:

A back coat layer was formed in the same manner as in Example 1, except that the coating liquid 1 for outermost layer was replaced by the coating liquid 4 for outermost back layer. There was thus obtained a thermosensitive recording material 4.

Comparative Example 1

Preparation of Coating Liquid for Outermost Back Layer:

A coating liquid 5 for outermost back layer was obtained in the same manner as in Example 1, except that in Example 1, the aluminum hydroxide dispersion was not added.

Formation of Back Coat Layer:

A back coat layer was formed in the same manner as in Example 1, except that the coating liquid 1 for outermost layer was replaced by the coating liquid 5 for outermost back layer and that its applied amount was changed to 1.2 g/m$^2$. There was thus obtained a thermosensitive recording material 5.

Comparative Example 2

Preparation of Coating Liquid for Outermost Back Layer:

A coating liquid 6 for outermost back layer was obtained in the same manner as in Example 1, except that in Comparative Example 1, the synthetic mica dispersion was not added.

Formation of Back Coat Layer:

A back coat layer was formed in the same manner as in Example 1, except that the coating liquid 5 for outermost layer was replaced by the coating liquid 6 for outermost back layer and that its applied amount was changed to 1.0 g/m$^2$. There was thus obtained a thermosensitive recording material 6.

Comparative Example 3

Preparation of Coating Liquid for Outermost Back Layer:

A coating liquid 7 for outermost back layer was obtained in the same manner as in Example 1, except that in Example 1, the synthetic mica dispersion was not added.

Formation of Back Coat Layer:

A back coat layer was formed in the same manner as in Example 1, except that the coating liquid 1 for outermost layer was replaced by the coating liquid 7 for outermost back layer and that its applied amount was changed to 2.1 g/m$^2$. There was thus obtained a thermosensitive recording material 7.

Coefficient of Friction:

Using plural pieces of each of the thus obtained thermosensitive recording materials 1 to 7, a coefficient of friction to each of the protective layer and the back coat layer was measured in the following manner. The measurement results are shown in Table 1.

A thermosensitive recording material (10 cm×15 cm) humidified at 23° C. at 65% was fixed on a horizontal table such that the hack surface (non-color development layer (thermosensitive recording layer) surface) was positioned upward, and another thermosensitive recording material humidified similarly was superimposed thereon such that the front surface of the thermosensitive recording material was positioned downward. On the two superimposed thermosensitive recording materials, was placed a metal weight of 1,050 g. A force gauge (trade name: DFG-1K, manufactured by SHIPO) was connected to the upper-side thermosensitive material, and a force applied when it was moved at a rate of 5 mm/sec was measured. A value obtained by dividing the measured value with the weight applied was defined as a coefficient of friction. The case where the coefficient of friction was in the range of from 0.4 to 0.5 was evaluated as "A", and the case where the coefficient of friction fell outside the above-specified range was evaluated as "B".

Evaluation of Curling:

Using each of the thus obtained thermosensitive recording materials 1 to 7, the curling was evaluated in the following manner. The evaluation results are shown in Table 1 below.

Each thermosensitive recording material in a sheet form was printed in a gray solid state into a A6 size under the environmental condition at 23° C. at 20% RH using FUJIX DIGITAL COLOR PRINTER NC370D (trade name, manufactured by Fuji Photo Film Co., Ltd.). The curling amount (a mean lifting amount [mm] of four corners of the thermosensitive recording material from the flat surface when standing on the flat surface) was measured immediately after printing and one day after printing, respectively. The thus measured curling amount was made an index for exhibiting the degree of curling.

Incidentally, with respect to the measured value, when the thermosensitive recording material curls and lifts in the side having the thermosensitive recording layer (front surface side), the amount is expressed with "+", whereas when it curls and lifts in the side having the back coat layer (back surface side), the amount is expressed with "−". The case where the curling value was in the range of from −25 to +15 was evaluated as "A", and the case where the curling value fell outside the above-specified range was evaluated as "B".

Overall Evaluation:

The case where good results were obtained in both of the coefficient of friction and the curling was evaluated as "A", and the case where good results were not obtained in even one of the coefficient of friction and the curling was evaluated as "B".

TABLE 1

| | Coefficient of friction | Evaluation | Curling | Evaluation | Overall evaluation |
|---|---|---|---|---|---|
| Example 1 | 0.44 | A | −18/+15 | A | A |
| Example 2 | 0.45 | A | −20/+13 | A | A |
| Example 3 | 0.42 | A | −17/+15 | A | A |
| Example 4 | 0.44 | A | −18/+14 | A | A |
| Comparative Example 1 | 0.29 | B | −16/+13 | A | B |
| Comparative Example 2 | 0.30 | B | −26/+18 | B | B |
| Comparative Example 3 | 0.46 | A | −28/+13 | B | B |

As is clear from Table 1, all of thermosensitive recording materials of Examples 1 to 4 gave rise to good results in both of the coefficient of friction and the curling, whereas the thermosensitive recording materials of Comparative Examples 1 to 3 did not give rise to satisfactory results simultaneously in the evaluations of the coefficient of friction and the curling.

According to the invention, it is possible to provide a thermosensitive recording material capable of preventing curling caused by a change in the environment or by application of heat during the recording and of regulating a coefficient of friction of a back coat layer within a predetermined range.

What is claimed is:

1. A thermosensitive recording material comprising a thermosensitive recording layer on one surface of a support and a back coat layer on the other surface of the support, wherein the back coat layer comprises multiple layers, and the outermost layer of the back coat layer furthest from the support contains polyvinyl alcohol, an inorganic stratiform compound, and an inorganic pigment, wherein the inorganic stratiform compound is selected from micas represented by the following formula (1):

$$A(B, C)_{2\text{-}3}D_4O_{10}(OH, F, O)_2 \quad (1)$$

wherein A represents K, Na, or Ca; B and C independently represent Fe(II), Fe(III), Mn, Al, Mg, or V; and D represents Si or Al.

2. The thermosensitive recording material according to claim 1, wherein the inorganic stratiform compound includes synthetic mica.

3. The thermosensitive recording material according to claim 2, wherein the synthetic mica has an aspect ratio of 100 or more.

4. The thermosensitive recording material according to claim 3, wherein the thermosensitive recording layer comprises a recording layer containing an electron-donating dye precursor and an electron-accepting compound, which reacts with the electron-donating dye precursor to make the electron-donating dye precursor undergo color development, and a recording layer containing a diazonium salt compound and a coupler which reacts with the diazonium salt compound to make the diazonium salt compound undergo color development.

5. The thermosensitive recording material according to claim 2, wherein the thermosensitive recording layer comprises a recording layer containing an electron-donating dye precursor and an electron-accepting compound, which reacts with the electron-donating dye precursor to make the electron-donating dye precursor undergo color development, and a recording layer containing a diazonium salt compound and a coupler, which reacts with the diazonium salt compound to make the diazonium salt compound undergo color development.

6. The thermosensitive recording material according to claim 1, wherein the thermosensitive recording layer comprises at least one of a recording layer containing an electron-donating dye precursor and an electron-accepting compound, which reacts with the electron-donating dye precursor to make the electron-donating dye precursor undergo color development, and a recording layer containing a diazonium salt compound and a coupler, which reacts with the diazonium salt compound to make the diazonium salt compound undergo color development.

7. The thermosensitive recording material according to claim 6, wherein at least one of the diazonium salt compound and the electron-donating dye precursor is encapsulated in a microcapsule.

8. The thermosensitive recording material according to claim 1, wherein the support is a paper support, at least one surface of which is laminated with polyethylene.

9. The thermosensitive recording material according to claim 1, wherein the polyvinyl alcohol has a degree of saponification of 88% or more.

10. The thermosensitive recording material according to claim 1, wherein the applied amount of the polyvinyl alcohol is within a range of from 0.3 to 5.3 g/m$^2$.

11. The thermosensitive recording material according to claim 1, wherein the polyvinyl alcohol has a degree of polymerization within a range of from 300 to 1,700.

12. The thermosensitive recording material according to claim 1, wherein particles of the inorganic stratiform compound have a mean long diameter within a range of from 0.3 to 20 μm and a mean thickness of 0.1 μm or less.

13. The thermosensitive recording material according to claim 1, wherein the content of the inorganic stratiform compound is within a range of from 3 to 30 parts by weight based on 100 parts by weight of the polyvinyl alcohol, and the content ratio of the inorganic stratiform compound (x) to the binder (y) (weight ratio: x/y) is within a range of from 3/100 to 20/100.

14. The thermosensitive recording material according to claim 1, wherein the inorganic stratiform compound has a particle size in the range of from 0.3 to 20 μm and a mean thickness of 0.1 μm or less.

15. The thermosensitive recording material according to claim 1, wherein the content of the inorganic pigment is within a range of from 30 to 500 parts by weight based on 100 parts by weight of the polyvinyl alcohol, and the volume average particle size of the inorganic pigment is within a range of from 0.1 to 2.0 μm.

* * * * *